US009966701B2

(12) United States Patent
Tabata et al.

(10) Patent No.: US 9,966,701 B2
(45) Date of Patent: May 8, 2018

(54) CONNECTOR DEVICE

(71) Applicant: JAPAN AVIATION ELECTRONICS INDUSTRY, LIMITED, Shibuya-ku, Tokyo (JP)

(72) Inventors: Yuya Tabata, Tokyo (JP); Osamu Hashiguchi, Tokyo (JP)

(73) Assignee: JAPAN AVAITION ELECTRONICS INDUSTRY, LIMITED, Tokyo (JP)

( * ) Notice: Subject to any disclaimer, the term of this patent is extended or adjusted under 35 U.S.C. 154(b) by 0 days. days.

(21) Appl. No.: 15/663,405

(22) Filed: Jul. 28, 2017

(65) Prior Publication Data

US 2018/0054025 A1 Feb. 22, 2018

(30) Foreign Application Priority Data

Aug. 16, 2016 (JP) ..... 2016-159602

(51) Int. Cl.

| | |
|---|---|
| ***H01R 13/641*** | (2006.01) |
| ***H01R 13/633*** | (2006.01) |
| ***H01R 24/00*** | (2011.01) |
| ***H01R 13/629*** | (2006.01) |

(52) U.S. Cl.

CPC ..... *H01R 13/641* (2013.01); *H01R 13/6295* (2013.01); *H01R 13/62933* (2013.01); *H01R 13/62966* (2013.01)

(58) Field of Classification Search

CPC ..... H01R 13/62933; H01R 13/641; H01R 13/62966; H01R 13/6295; H01R 24/00

See application file for complete search history.

(56) References Cited

U.S. PATENT DOCUMENTS

| | | | | |
|---|---|---|---|---|
| 6,755,673 | B2 | 6/2004 | Fukushima et al. | |
| 7,438,570 | B2 * | 10/2008 | Mori | H01R 13/62933 439/157 |
| 9,018,550 | B2 * | 4/2015 | Kobayashi | H01H 9/0066 200/50.01 |
| 9,048,045 | B2 * | 6/2015 | Henmi | H01R 13/62933 |
| 9,325,112 | B2 | 4/2016 | Tabata et al. | |

FOREIGN PATENT DOCUMENTS

| | | |
|---|---|---|
| JP | 2002343169 A | 11/2002 |
| JP | 2015050116 A | 3/2015 |

* cited by examiner

*Primary Examiner* — Briggitte R Hammond
(74) *Attorney, Agent, or Firm* — Holtz, Holtz & Volek PC

(57) ABSTRACT

In an open position, a power-supply terminal and a detection terminal are not connected to a mating power-supply terminal and a mating detection terminal, respectively. In a predetermined position, the power-supply terminal is connected to the mating power-supply terminal while the detection terminal is not connected to the mating detection terminal. In a closed position, the power-supply terminal and the detection terminal are connected to the mating power-supply terminal and the mating detection terminal, respectively. When the connector is turned toward the predetermined position from the closed position, a first regulating portion regulates a first regulated portion to prevent the connector from reaching the predetermined position. When the connector is turned toward the predetermined position after the regulation is released, a second regulating portion regulates a second regulated portion to prevent the connector from being turned toward the open position beyond the predetermined position.

15 Claims, 29 Drawing Sheets

CONNECTOR DEVICE

CROSS REFERENCE TO RELATED APPLICATIONS

This application is based on and claims priority under 35 U.S.C. § 119 to Japanese Patent Application No. JP2016-159602 filed Aug. 16, 2016, the contents of which are incorporated herein in their entirety by reference.

BACKGROUND OF THE INVENTION

This invention relates to a connector device which is mounted on, for example, an electric vehicle or a hybrid car and relays electric power supplied from a power source system.

A connector device of this type may be used to relay a large current of about 100 A. Accordingly, it is necessary that the connector is provided with a mechanism for safety of maintenance workers. A connector device of this type is disclosed in JPA 2002-343169 (Patent Document 1), for example.

As shown in FIGS. 37A-37C, a lever fitting type power source circuit interruption device (a connector device) is provided with a connector, a mating connector and a lever. The lever is operably supported by the connector. The lever is provided with cam grooves while the mating connector is provided with cam pins. The cam pins are inserted in the cam grooves. The connector is provided with a male terminal or a power-supply terminal (not shown) forming a part of a power-supply circuit. The lever is provided with a fitting detection male terminal or a detection terminal (not shown). The mating connector is provided with a female terminal or another power-supply terminal (not shown) forming another part of the power-supply circuit and a fitting detection female terminal or another detection terminal (not shown).

As understood from FIGS. 37A and 37B, when the lever is pushed down, the connector is moved downward, and the male terminal and the female terminal are connected to each other. Thus, the power-supply circuit is formed. As understood from FIGS. 37B and 37C, when the lever is slid in a horizontal direction, the fitting detection male terminal and the fitting detection female terminal are connected to each other so that the power-supply circuit is energized. In order to detach the connector from the mating connector, the aforementioned operations are carried out in inverse order. Specifically, at first, the lever is slid in an opposite direction opposite to the direction in the case of the connecting. Next, the lever is raised to disconnect the male terminal and the female terminal from each other.

SUMMARY OF THE INVENTION

In order to prevent the workers from receiving an electric shock, a sufficient elapse time is necessary from a timing of disconnection between the fitting detection male terminal and the fitting detection female terminal to another timing of disconnection between the male terminal and the female terminal. In other words, a certain time difference is necessary between disconnecting the detection terminals from each other and disconnecting the power-supply terminals from each other. Similarly, it is desirable that there is a certain time difference between connecting the power-supply terminals to each other and connecting the detection terminals to each other.

However, in the connector device of Patent Document 1, the sliding operation of the lever and the raising operation of the lever can be continuously carried out. Hence, in the connector device of Patent Document 1, there is a possibility that disconnection of the detection terminals and disconnection of the power-supply terminals are performed almost without a time difference therebetween and that connection of the power-supply terminals and connection of the detection terminals are performed almost without a time difference therebetween.

It is, therefore, an object of the present invention to provide a connector device which can ensure a sufficient time between the connection or the disconnection of the detection terminals and the connection or the disconnection of the power-supply terminals.

One aspect of the present invention provides a connector device comprising a connector and a mating connector which is mateable with the connector. The connector comprises a housing, a power-supply terminal and a detection terminal. The housing is formed with an axis portion. The power-supply terminal and the detection terminal are held by the housing. The mating connector comprises a mating housing, a mating power-supply terminal and a mating detection terminal. The mating housing is formed with a mating axis portion. One of the axis portion and the mating axis portion is a rotation axis with an axis direction while a remaining one of the axis portion and the mating axis portion is a bearing. When the axis portion and the mating axis portion are combined, the connector is rotatable around the rotation axis between an open position and a closed position with respect to the mating connector. The mating power-supply terminal and the mating detection terminal are held by the mating housing. When the connector is positioned between the open position and the closed position, the connector is located above the mating connector in an up-down direction orthogonal to the axis direction of the rotation axis. When the connector is positioned in the open position, the power-supply terminal is not connected to the mating power-supply terminal while the detection terminal is not connected to the mating detection terminal. When the connector is positioned in a predetermined position located between the open position and the closed position, the power-supply terminal is connected to the mating power-supply terminal while the detection terminal is not connected to the mating detection terminal. When the connector is positioned in the closed position, the power-supply terminal and the detection terminal are connected to the mating power-supply terminal and the mating detection terminal, respectively. The housing is provided with a first regulated portion and a second regulated portion. The mating housing is provided with a first regulating portion and a second regulating portion. One of the housing and the mating housing is provided with a first release portion. One of the housing and the mating housing is provided with a second release portion. When the connector is turned toward the predetermined position from the closed position, the first regulated portion is brought into abutment with the first regulating portion and regulated to prevent the connector from reaching the predetermined position. When the first release portion is operated, regulation by the first regulating portion for the first regulated portion is released. When the connector is turned toward the predetermined position after releasing the regulation for the first regulated portion, the second regulated portion is brought into abutment with the second regulating portion and regulated to prevent the connector from being turned toward the open position beyond the predetermined position. When the second release portion is operated, regulation by the second regulating portion for the second regulated portion is released.

Another aspect of the present invention provides a connector device comprising a connector and a mating connector which is mateable with the connector. The connector comprises a housing, a power-supply terminal and a detection terminal. The housing is formed with an axis portion. The power-supply terminal and the detection terminal are held by the housing. The mating connector comprises a mating housing, a mating power-supply terminal and a mating detection terminal. The mating housing is formed with a mating axis portion. One of the axis portion and the mating axis portion is a rotation axis with an axis direction while a remaining one of the axis portion and the mating axis portion is a bearing. When the axis portion and the mating axis portion are combined with each other, the connector is rotatable around the rotation axis between an open position and a closed position with respect to the mating connector. The mating power-supply terminal and the mating detection terminal are held by the mating housing. When the connector is positioned between the open position and the closed position, the connector is located above the mating connector in an up-down direction orthogonal to the axis direction of the rotation axis. When the connector is positioned in the open position, the power-supply terminal is not connected to the mating power-supply terminal while the detection terminal is not connected to the mating detection terminal. The connector is positioned in a regulation position which is located between the open position and the closed position, the power-supply terminal is connected to the mating power-supply terminal while the detection terminal is not connected to the mating detection terminal. When the connector is positioned in the closed position, the power-supply terminal and the detection terminal are connected to the mating power-supply terminal and the mating detection terminal, respectively. The housing is provided with a base portion, a cantilever portion which is resiliently deformable, a fitting regulated portion and an operation portion. The cantilever portion extends from the base portion in a first predetermined orientation and has a thickness in a second predetermined orientation orthogonal to the first predetermined orientation. The fitting regulated portion and the operation portion are supported by the cantilever portion. The fitting regulated portion has a portion which is located within the thickness of the cantilever portion in the second predetermined orientation. When the cantilever portion is resiliently deformed, the fitting regulated portion is moved at least in the second predetermined orientation. The mating housing is provided with a fitting regulating portion. When the connector is turned from the open position to the regulation position, the portion of the fitting regulated portion located within the thickness of the cantilever portion is brought into abutment with the fitting regulating portion and regulated to prevent the connector from being turned toward the closed position beyond the regulation position. When the operation portion is operated to deform the cantilever portion resiliently, the regulation by the fitting regulating portion for the fitting regulated portion is released.

When the connector is turned from the closed position, the first regulated portion is brought into abutment with the first regulating portion and regulated to prevent the connector from being turned. In order to release the regulation, it is necessary to operate the first release portion. Moreover, after the regulation by the first regulating portion for the first regulated portion is released, when the connector is turned toward the open position, the second regulated portion is brought into abutment with the second regulating portion and regulated to prevent the connector from being turned toward the open position beyond the predetermined position. In order to release the regulation, it is necessary to operate the second release portion. Like this, in order to turn the connector from the closed position to the open position via the predetermined position, it is necessary to operate the first release portion and the second release portion separately. Consequently, a sufficient time can be certainly ensured from a timing of disconnection between the detection terminal and the mating detection terminal to another timing of disconnection between the power-supply terminal and the mating power-supply terminal.

In addition, when the connector is turned toward the closed position from the open position, the fitting regulated portion is brought into abutment with the fitting regulating portion and regulated to prevent the connector from being turned toward the closed position beyond the regulation position. The fitting regulated portion is located within the thickness of the cantilever portion in the second predetermined orientation. Accordingly, even when the connector is given with a force to turn the connector toward the closed position, there is no case where the cantilever portion is deformed to release the regulation. Hence, the regulation can be certainly performed to regulate that the connector is turned toward the closed position beyond the regulation position. The regulation can be released by operating the operation portion to deform the cantilever portion resiliently. Thus, a time interval can be certainly ensured from a timing of disconnection between the power-supply terminal and the mating power-supply terminal to another timing of disconnection between the detection terminal and the mating detection terminal.

An appreciation of the objectives of the present invention and a more complete understanding of its structure may be had by studying the following description of the preferred embodiment and by referring to the accompanying drawings.

Figure 1:
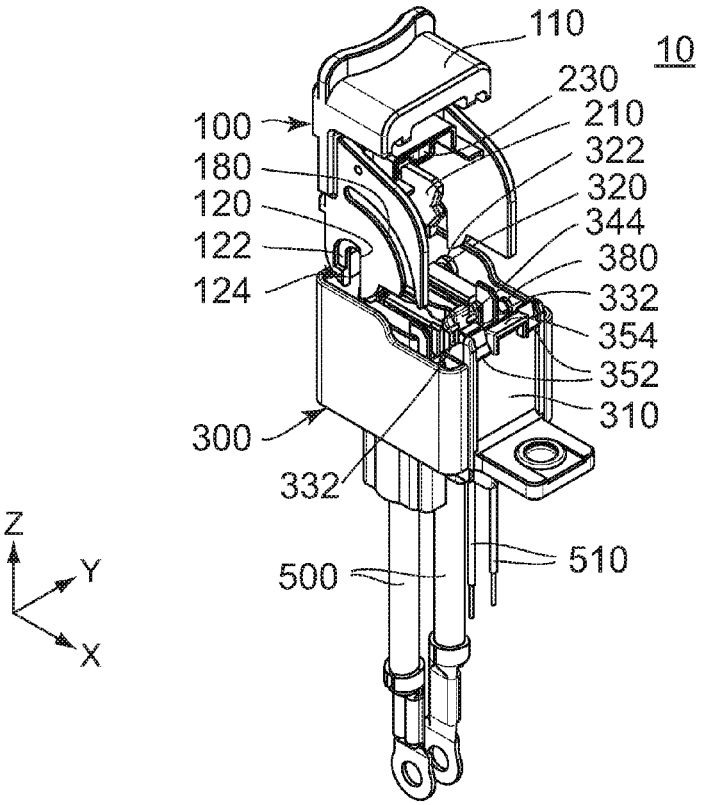
FIG. 1 is a perspective view showing a connector device according to an embodiment of the present invention. A connector is separated from a mating connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector device 10 according to an embodiment of the present invention is provided with a connector 100 and a mating connector 300. When the mating connector 300 is used, it is attached to an object (not shown) such as an electric vehicle and connected to a power-supply system (not shown) and a motor (not shown). When the connector 100 is fitted with the mating connector 300, the connector device 10 connects the power-supply system to the motor, and a current supplied from the power-supply system is supplied to the motor.

Figure 5:
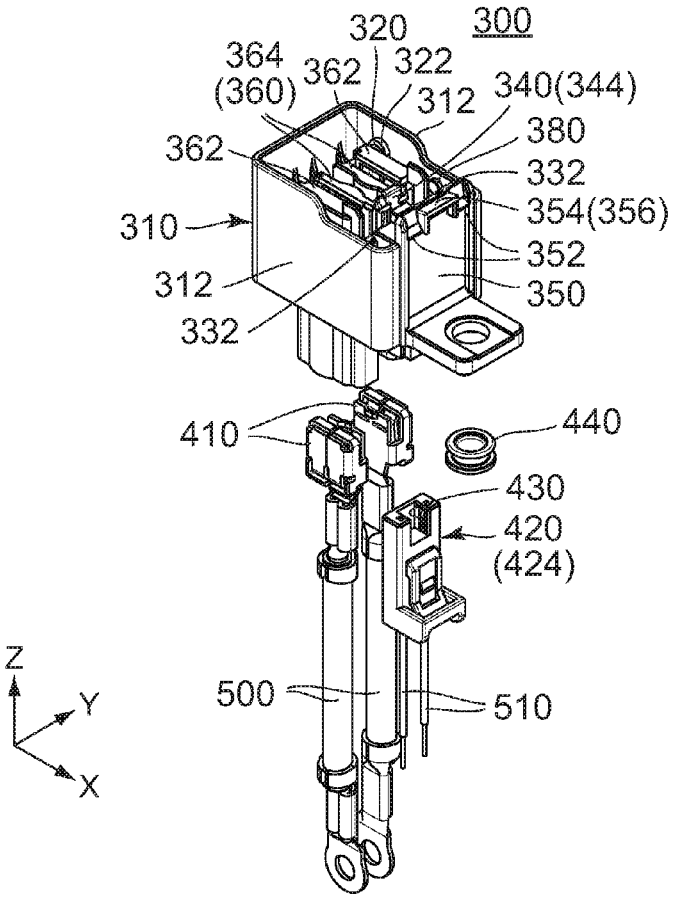
FIG. 5 is an exploded perspective view showing the mating connector included in the connector device of FIG. 1.

As shown in FIG. 5, the mating connector 300 is provided with a mating housing 310, two mating power-supply terminals 410, a mating sub-connector 420 and an eyelet 440.

Figure 6:
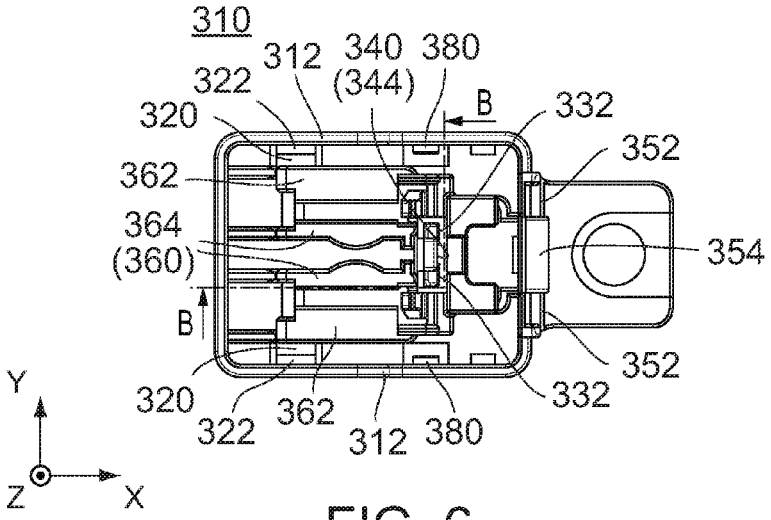
FIG. 6 is a plan view showing a mating housing included in the mating connector of FIG. 5.

Referring to FIGS. 5 and 6, the mating housing 310 is formed with two mating axis portions 320 and two mating guide portions (guide portions) 380. The mating axis portions 320 are rotation axes which have an axis direction extending along a Y-direction. The mating axis portions 320 are located apart from each other in the axis direction and arranged in symmetrical positions. A set of the mating axis portions 320 has two outer ends in the axis direction. The outer ends of the mating axis portions 320 are formed with flanges 322, respectively. The mating axis portions 320 and the flanges 322 form two combinations. In each of the combinations of the mating axis portions 320 and the flanges 322, the flange 322 overhangs from the mating axis portion 320 at least upward and downward in an orthogonal plane orthogonal to the axis direction. In the present embodiment, the mating housing 310 has a pair of sidewalls 312 and two sets of power-supply terminal holding portions 360. Each of the power-supply terminal holding portions 360 has an outer power-supply terminal holding portion 362 and an inner power-supply terminal holding portion 364. The combinations of the mating axis portions 320 and the flanges 322 correspond to the sidewalls 312, respectively, and correspond to the power-supply terminal holding portions 360, respectively. Each of the combinations of the mating axis portions 320 and the flanges 322 is located between the sidewall 312 corresponding thereto and the outer power-supply terminal holding portion 362 corresponding thereto. At least one of the mating axis portion 320 and the flange 322 is supported by one of the outer power-supply terminal holding portion 362 and the sidewall 312. In the present embodiment, the mating axis portions 320 are supported by the outer power-supply terminal holding portions 362 while the flanges 322 are supported by the sidewalls 312. In the present embodiment, the orthogonal plane is an X-Z plane. An up-down direction is a Z-direction. A positive Z direction is directed upward while a negative Z direction is directed downward. The mating guide portions 380 are protrusions and protrude inward from the sidewalls 312 in the axis direction. The mating guide portions 380 are opposed to each other in the axis direction.

Figure 7:
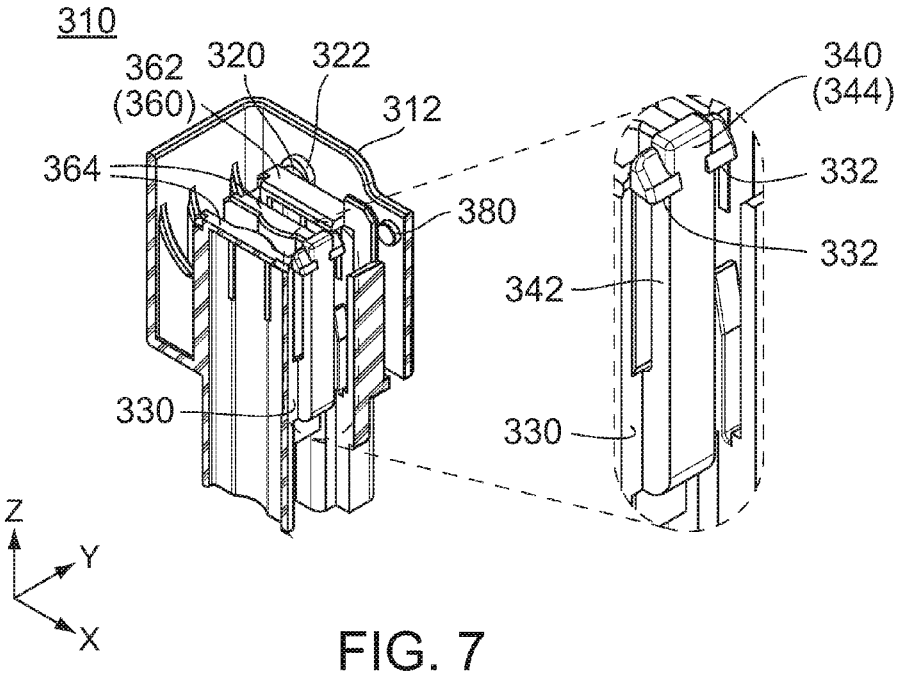
FIG. 7 is a cross-sectional, perspective view showing a part of the mating housing of FIG. 6. The mating housing is cut along line B-B. First regulating portions, a first release portion and a periphery of them are enlarged and illustrated.
Figure 8:
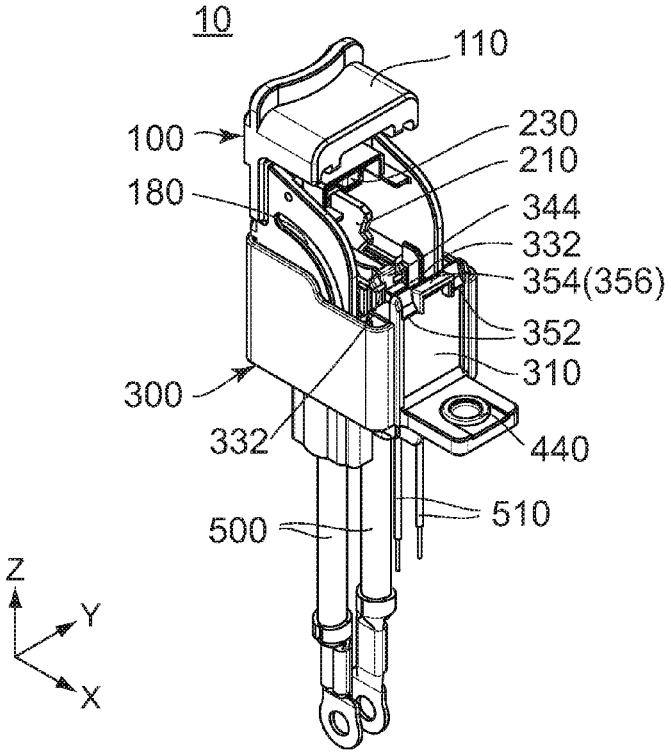
FIG. 8 is another perspective view showing the connector device of FIG. 1. The connector is in an open position.
Figure 9:
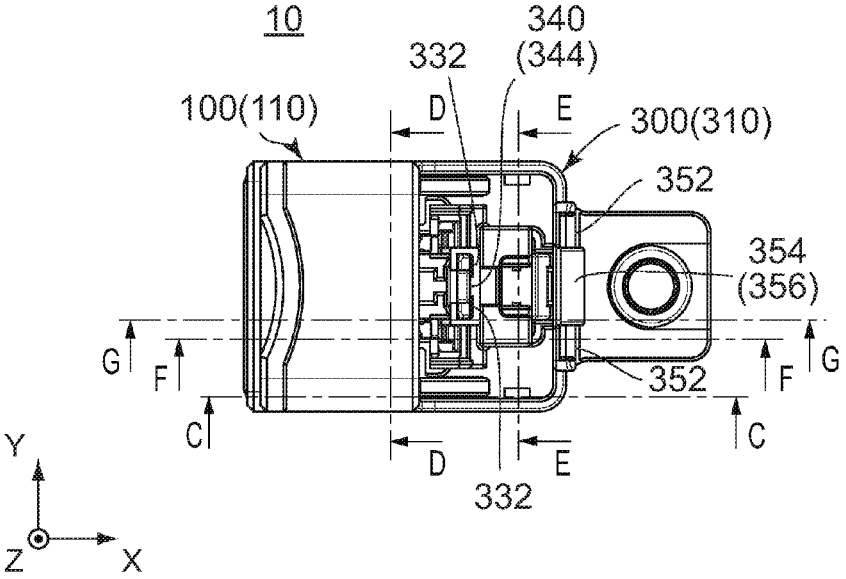
FIG. 9 is a plan view showing the connector device of FIG. 8.
Figure 13:
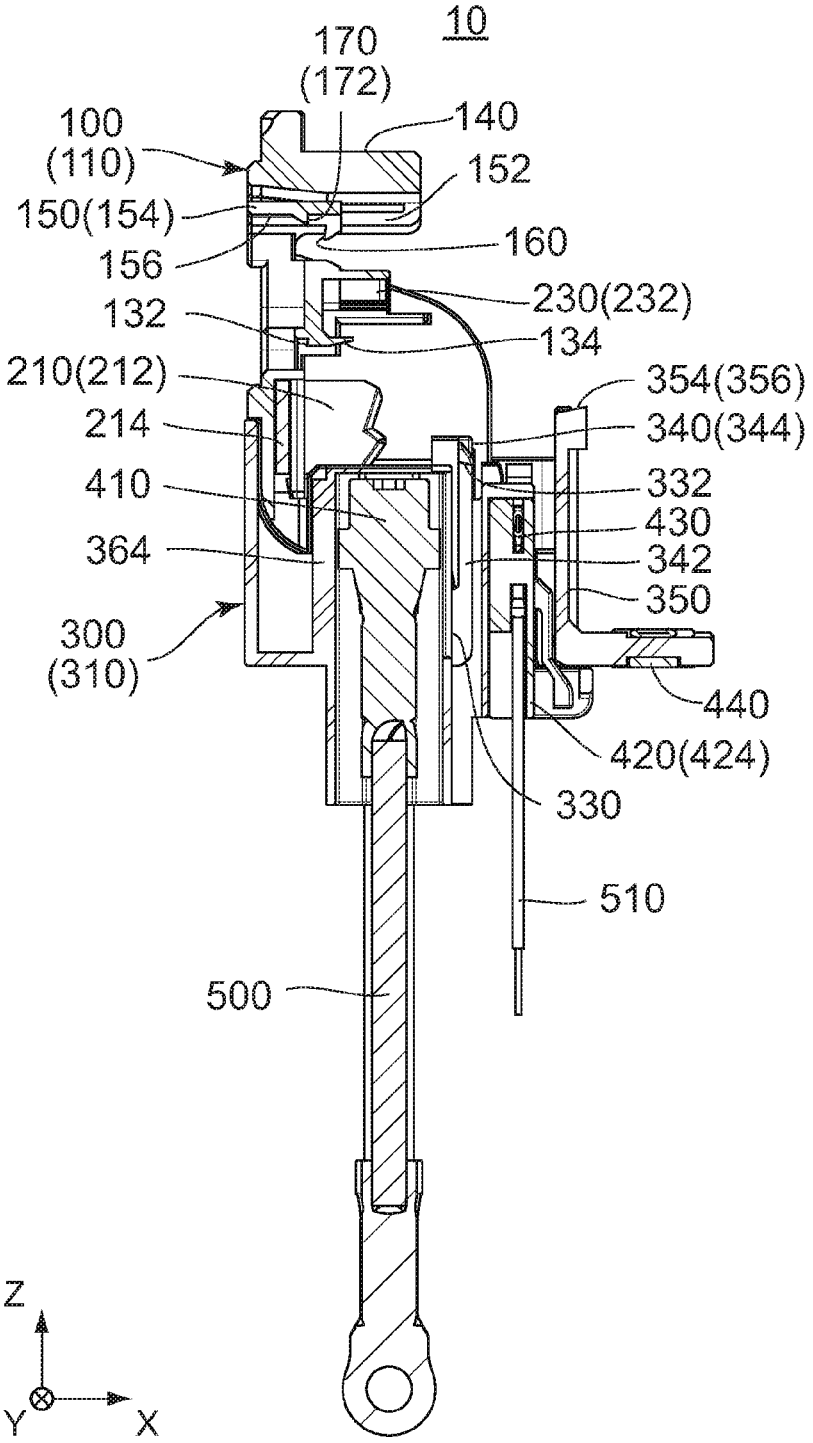
FIG. 13 is a cross-sectional view showing the connector device of FIG. 9, taken along line F-F.

As shown in FIGS. 5 to 7, the mating housing 310 has two first regulating portions 332 and a first release portion 340. In the present embodiment, the first release portion 340 has a first spring portion 342 and a first operation portion 344. The first spring portion 342 protrudes backward from an inner wall portion 330, which couples the inner power-supply terminal holding portions 364 of the mating housing 310 with each other, in a front-rear direction orthogonal to the axis direction and then extends upward in the up-down direction orthogonal to both of the axis direction and the front-rear direction. In other words, the first spring portion 342 has a cantilever structure. In the present embodiment, the front-rear direction is an X-direction. A negative X-direction is directed frontward while a positive X-direction is directed rearward. The first operation portion 344 is located at an upper end (a first upper end) of the first spring portion 342 and supported by the first spring portion 342. The first regulating portions 332 are located near a free end of the first spring portion 342 and supported by the first spring portion 342. In detail, the first regulating portions 332 are provided outside the first spring portion 342 in the axis direction and protrude rearward. The first regulating portions 332 have shapes symmetric to each other. As shown in FIG. 13, the first regulating portion 332 has a lower surface. The lower surface of the first regulating portion 332 intersects obliquely the up-down direction to be inclined frontward. Moreover, the first regulating portion 332 has an upper surface. The upper surface of the first regulating portion 332 includes a plurality of flat surfaces each of which intersects obliquely the up-down direction to be inclined rearward.

As understood from FIGS. 5 to 7, the first spring portion 342 is resiliently deformable. Operating the first operation portion 344 allows the first spring portion 342 to be resiliently deformed. Therefore, the first regulating portions 332 can be moved at least in the front-rear direction.

Figure 14:
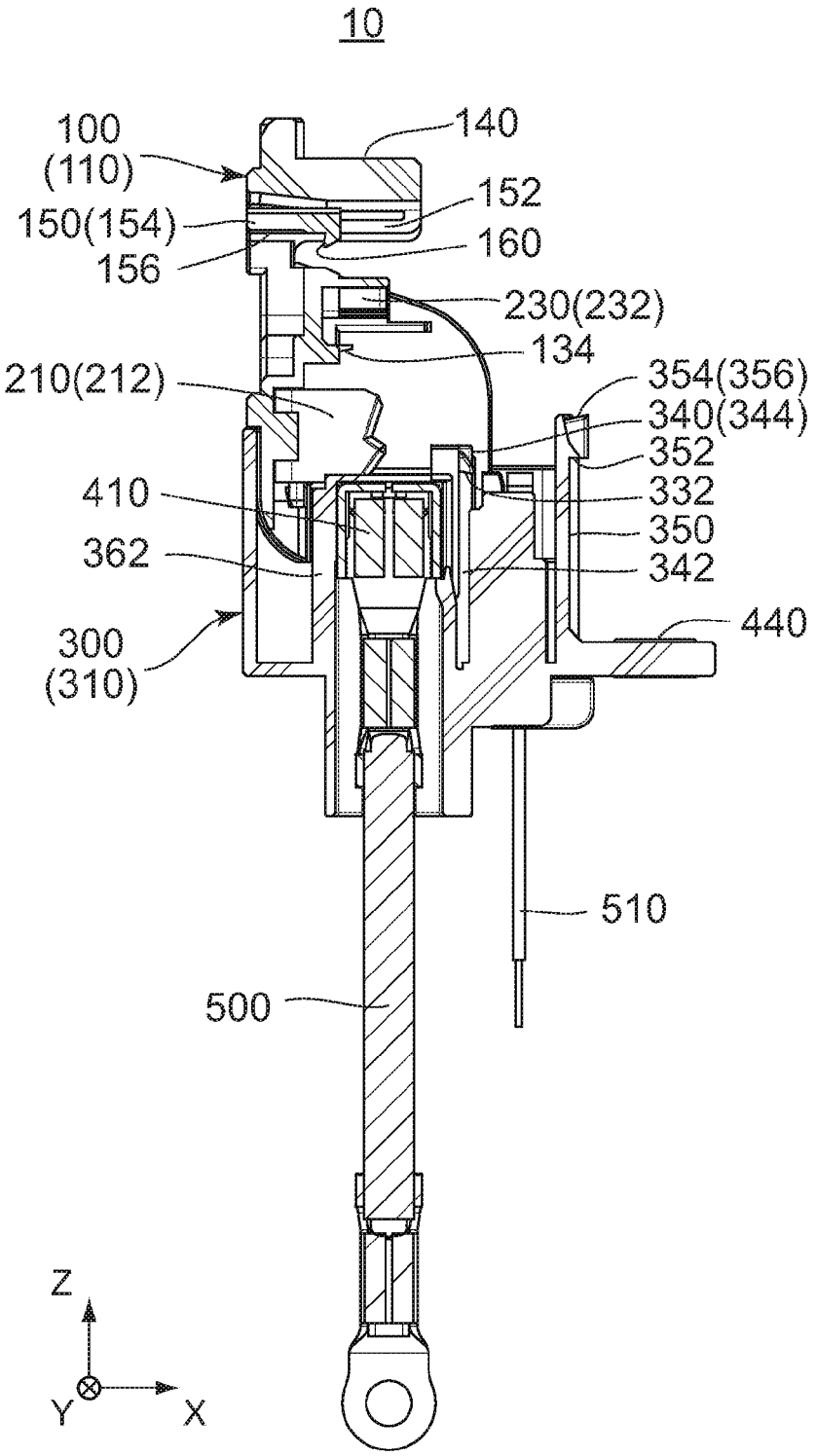
FIG. 14 is a cross-sectional view showing the connector device of FIG. 9, taken along line G-G.
Figure 15:
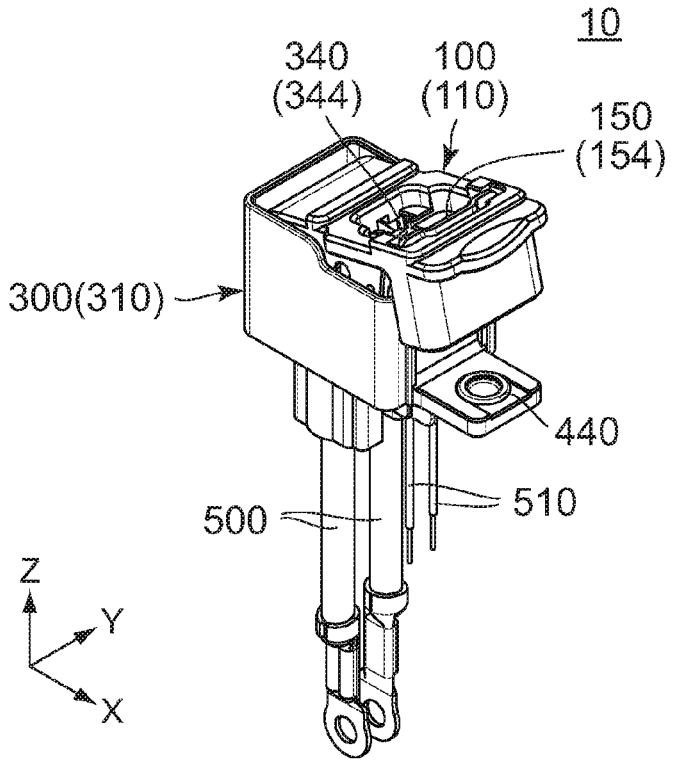
FIG. 15 is a still another perspective view showing the connector device of FIG. 1. The connector is in an additional predetermined position (a regulation position) between the open position and the closed position.
Figure 16:
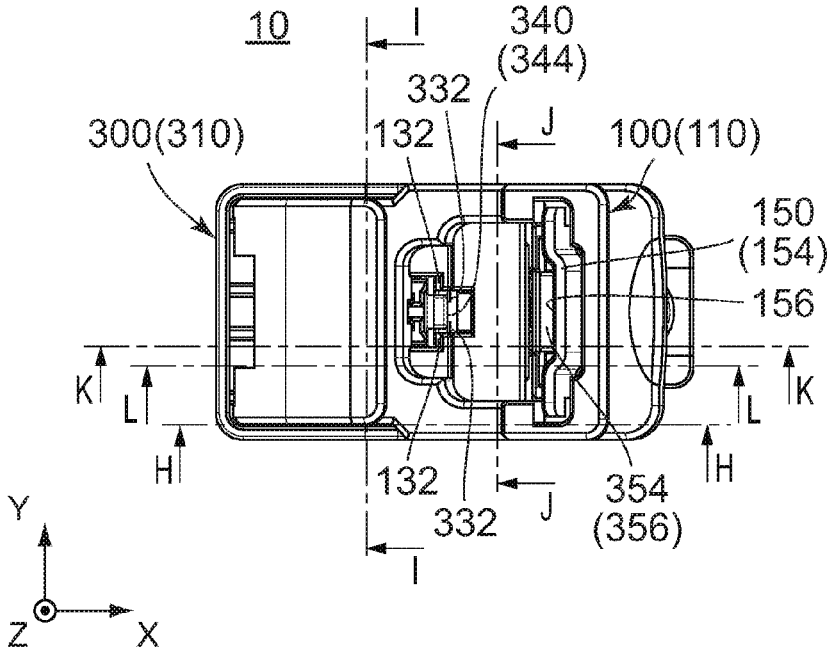
FIG. 16 is a plan view showing the connector device of FIG. 15.
Figure 17:
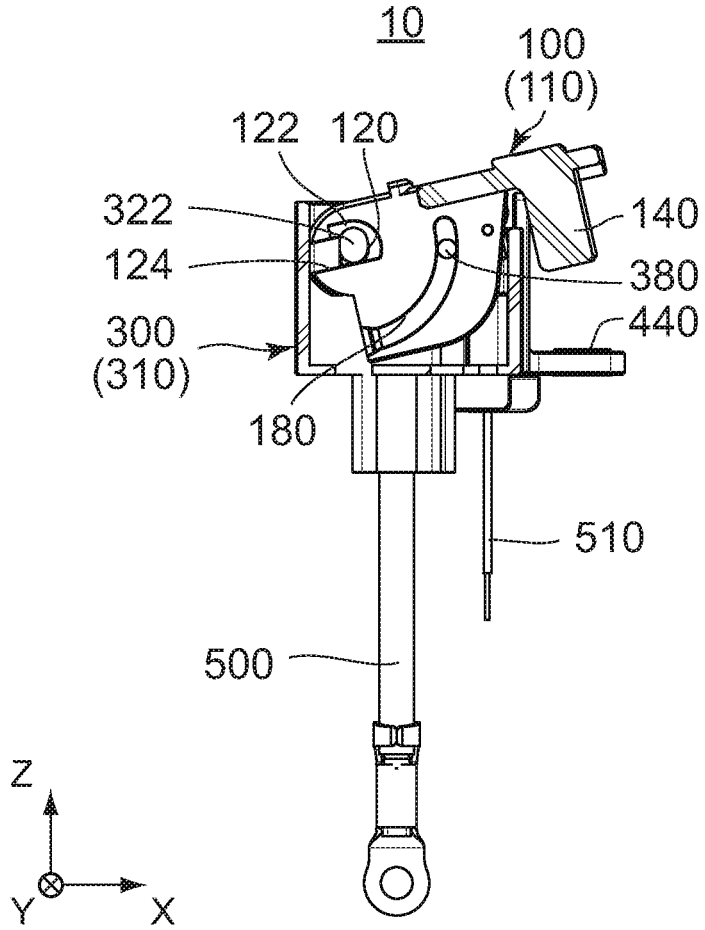
FIG. 17 is a cross-sectional view showing the connector device of FIG. 16, taken along line H-H.

As shown in FIG. 5, the mating housing 310 further has a rear wall 350. The rear wall 350 is located in a rear part of the mating housing 310 in the front-rear direction and extends in the up-down direction. The rear wall 350 is formed with two second regulating portions 352 and a fitting regulating portion (an additional regulating portion) 354. The second regulating portions 352 and the fitting regulating portion 354 protrude rearward. As shown in FIG. 14, the fitting regulating portion 354 is more protrusive rearward than the second regulating portion 352. As shown in FIG. 5, the second regulating portions 352 are located outside the fitting regulating portion 354 in the axis direction. The second regulating portions 352 have shapes symmetrical to each other. As shown in FIG. 14, the second regulating portion 352 has a lower surface and an upper surface. The lower surface of the second regulating portion 352 is orthogonal to the up-down direction while the upper surface of the second regulating portion 352 intersects obliquely the up-down direction. On the other hand, the fitting regulating portion 354 has a lower surface. As understood from FIG. 5, the lower surface of the fitting regulating portion 354 intersects obliquely the up-down direction. The lower surface of the fitting regulating portion 354 is inclined rearward. As shown in FIG. 13, the fitting regulating portion 354 has an upper surface as an abutment surface (a second abutment surface) 356. The abutment surface 356 intersects obliquely the up-down direction. In other words, the abutment surface 356 of the fitting regulating portion 354 intersects a horizontal plane orthogonal to the up-down direction. The abutment surface 356 is inclined forward.

As shown in FIG. 5, the mating power-supply terminals 410 are so-called socket contacts. As shown in FIGS. 11, 18, 25 and 32, each of the mating power-supply terminals 410 is provided with a contact 412. The contact 412 of the present embodiment is movable at least outward in the axis direction. As shown in FIG. 5, the mating power-supply terminals 410 are connected with power cables 500, respectively. The mating power-supply terminals 410 are held by the mating housing 310 and impossible to be relatively moved with respect to the mating housing 310. The mating power-supply terminals 410 are located apart from each other in the axis direction.

As shown in FIGS. 12, 19, 26 and 33, the mating sub-connector 420 is provided with a sub-housing 424 and two mating detection terminals 430. The mating detection terminals 430 are held by and fixed to the sub-housing 424. Moreover, the mating sub-connector 420 is held by and fixed to the mating housing 310. In other words, the mating detection terminals 430 are held by the mating housing 310 through the sub-housing 424 of the mating sub-connector 420 and impossible to be relatively moved with respect to the mating housing 310. In detail, the mating detection terminals 430 are located apart from each other in the axis direction and connected with signal lines 510, respectively. In addition, each of the mating detection terminals 430 is provided with a contact 432. The contact 432 of the present embodiment is movable at least outward in the axis direction.

Figure 2:
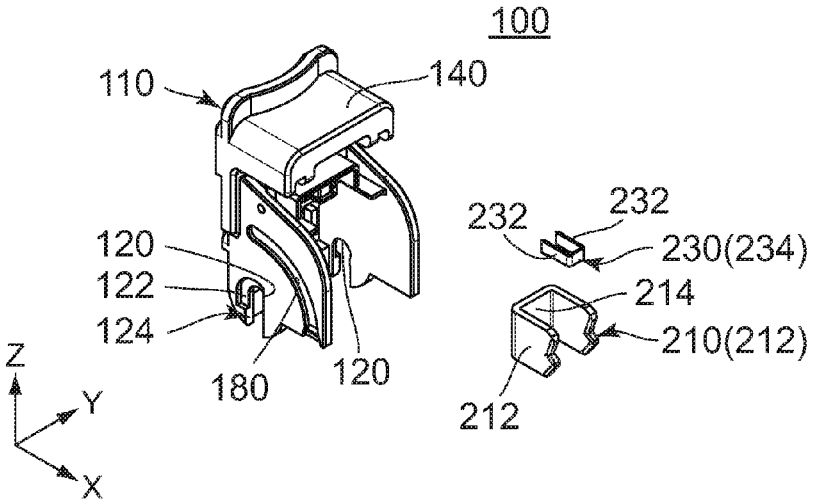
FIG. 2 is an exploded perspective view showing the connector included in the connector device of FIG. 1.

As shown in FIG. 2, the connector 100 is provided with a housing 110, a power-supply terminal 210 and a detection terminal 230.

Figure 10:
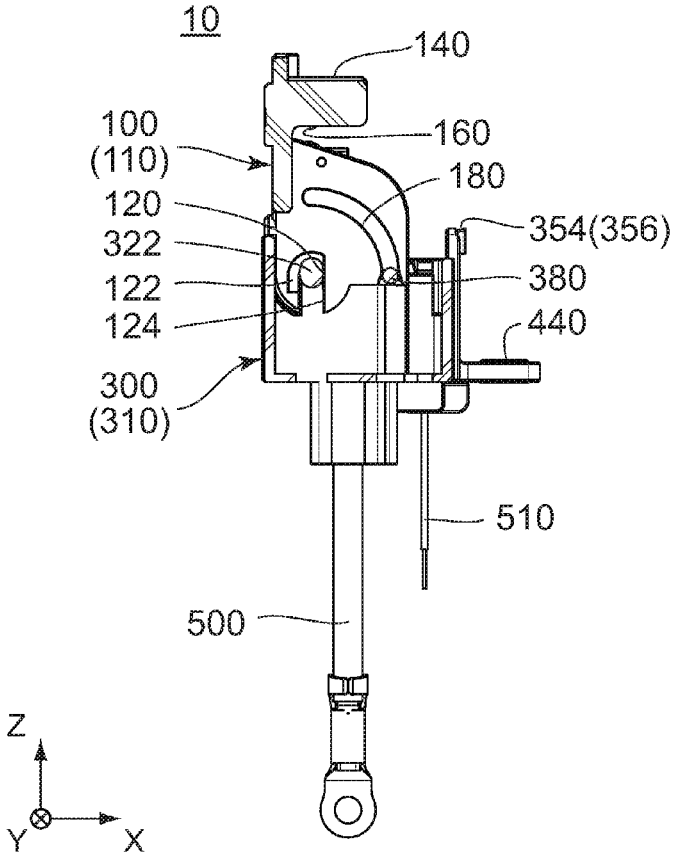
FIG. 10 is a cross-sectional view showing the connector device of FIG. 9, taken along line C-C.

As shown in FIGS. 2 and 10, the housing 110 is formed with two axis portions 120, two leading portions 124 and two guide portions (guided portions) 180. The axis portions 120 are bearings. The axis portions 120 are located apart from each other in the axis direction and arranged in symmetrical positions. Each of the axis portions 120 is formed with a flange guide portion 122. The flange guide portion 122 extends in the orthogonal plane. The leading portions 124 are provided to correspond to the axis portions 120, respectively. The leading portions 124 have shapes symmetrical to each other. As understood from FIGS. 1 and 10, the leading portions 124 are grooves for leading the rotation axes 320 to the axis portions 120, respectively. Each of the leading portions 124 extends in a radial direction of a cylindrical coordinates system (hereinafter referred to as a specific cylindrical coordinates system) centered on the rotation axis 320. The radial direction is orthogonal to the axis direction. As shown in FIG. 2, the leading portions 124 pierce the housing 110 in the axis direction. The guide portions 180 are grooves recessed in the axis direction and have shapes symmetrical to each other. Each of the guide portions 180 has an arc shape in the orthogonal plane. Although the guide portions 180 of the present embodiment are bottomed in the axis direction, they may be bottomless (or may pierce the housing 110 in the axis direction).

Figure 3:
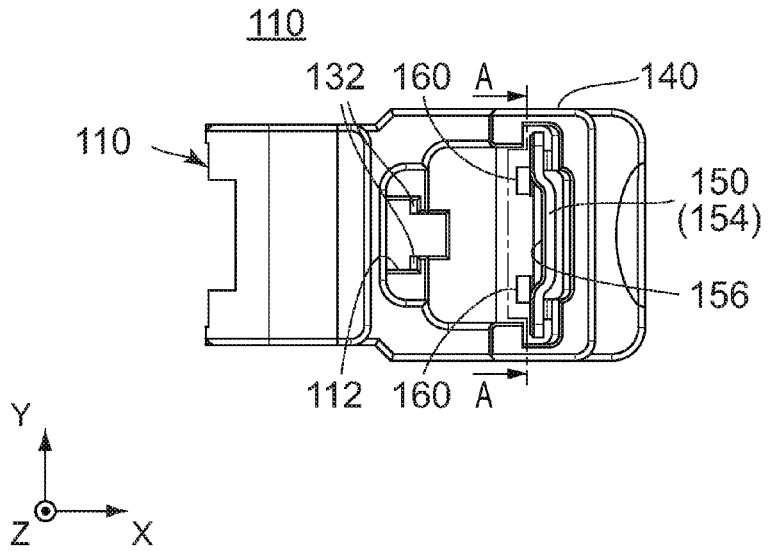
FIG. 3 is a plan view showing a housing included in the connector of FIG. 2. The housing illustrated is in a closed position.
Figure 11:
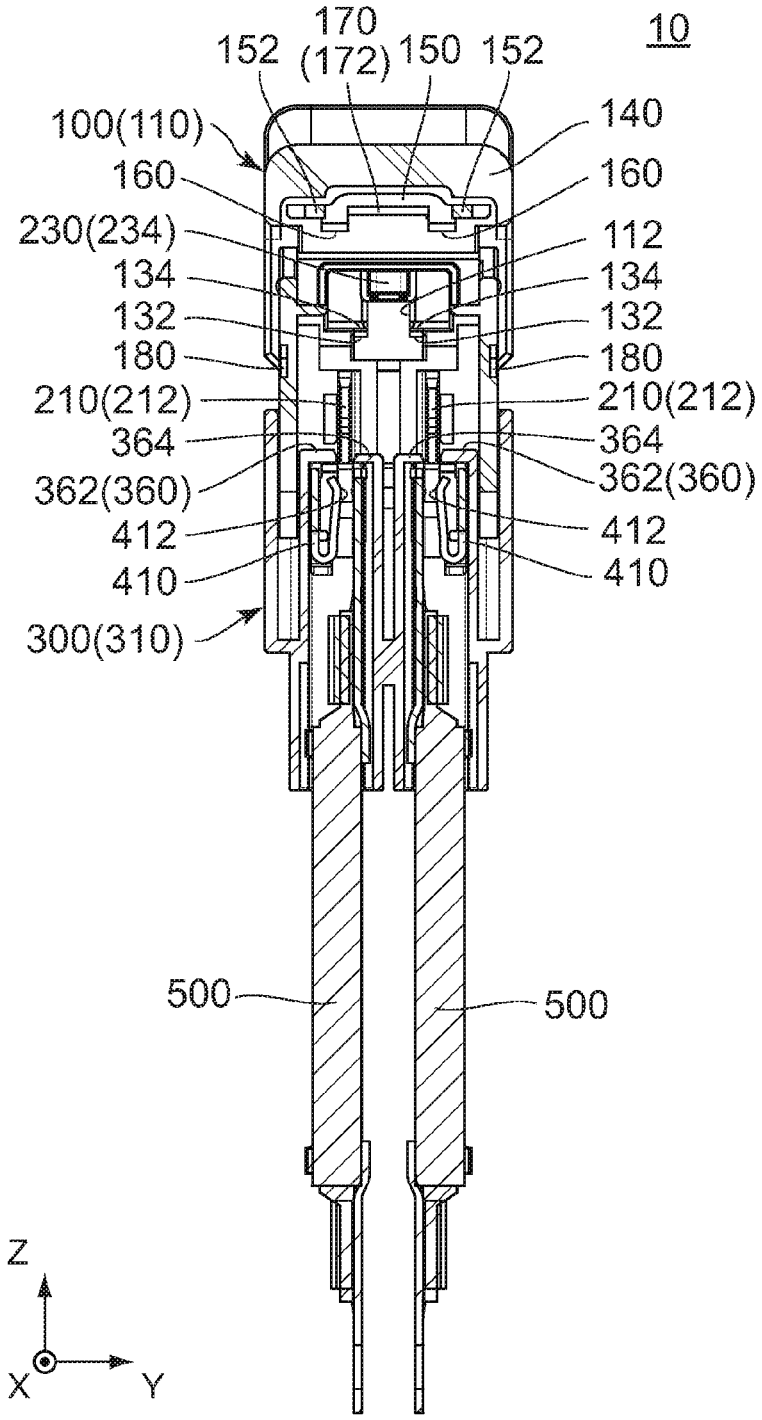
FIG. 11 is a cross-sectional view showing the connector device of FIG. 9, taken along line D-D.
Figure 27:
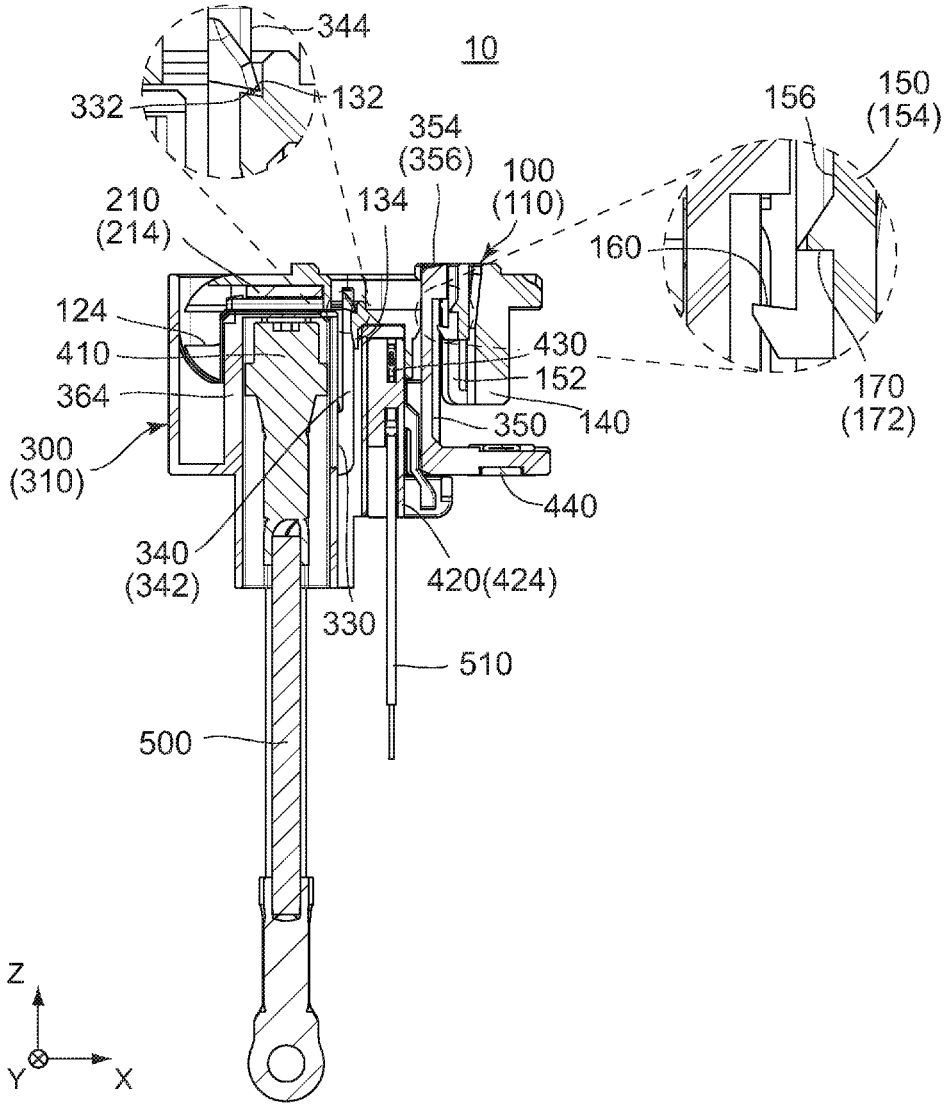
FIG. 27 is a cross-sectional view showing the connector device of FIG. 23, taken along line P-P. The first regulating portion and the periphery thereof and the fitting regulated portion and the periphery thereof are enlarged and illustrated, respectively.

Referring to FIGS. 3 and 11, the housing 110 is formed with two first regulated portions 132 and two lead portions 134. The first regulated portions 132 are arranged in symmetrical positions and have shapes symmetrical to each other. Similarly, the lead portions 134 are arranged in symmetrical positions and have shapes symmetrical to each other. The first regulated portions 132 correspond to the lead portions 134, respectively. As shown in FIG. 3, the housing 110 is formed with an opening 112 which has a T-shape. The first regulated portions 132 are visible through the opening 112. As understood from FIGS. 3 and 27, when the connector 100 is positioned in a closed position, the first regulated portions 132 protrude forward. As shown in FIG. 27, the first regulated portion 132 has an upper surface. The upper surface of the first regulated portion 132 intersects obliquely the up-down direction to be inclined rearward. As shown in FIG. 13, when the connector 100 is positioned in an open position, the lead portion 134 protrudes rearward from the first regulated portion 132 corresponding thereto.

Figure 4:
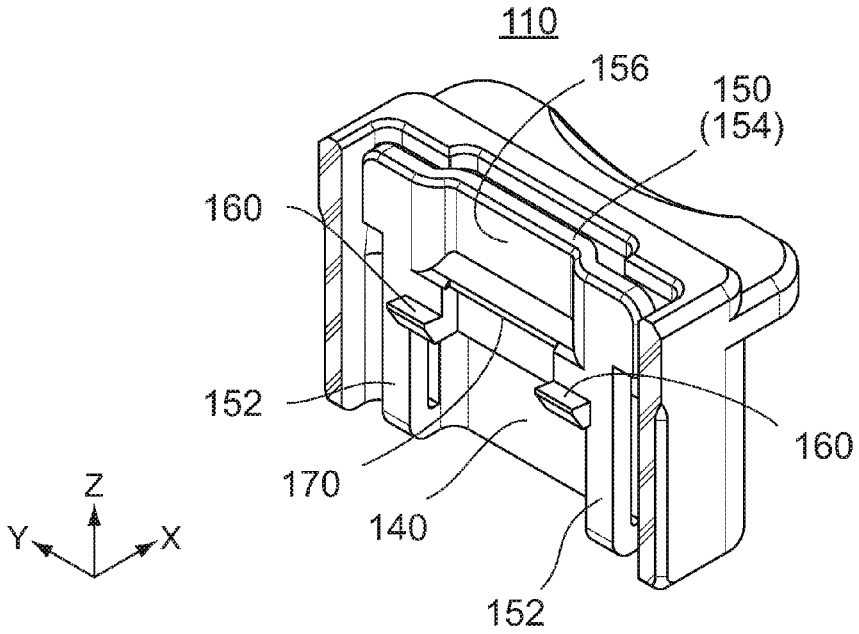
FIG. 4 is a cross-sectional, perspective view showing a part of the housing of FIG. 3. The housing is cut along line A-A.

As understood from FIGS. 2, 3 and 4, the housing 110 of the present embodiment is formed with a base portion 140, a second release portion 150, two second regulated portions 160 and a fitting regulated portion (an additional regulated portion) 170. The second release portion 150 has two second spring portions 152 which are resiliently deformable and a second operation portion 154 which is supported by the second spring portions 152. The second spring portions 152 support the second regulated portions 160 and the fitting regulated portion 170.

As understood from FIG. 4, the second spring portions 152 have shapes symmetrical to each other. Each of the second spring portions 152 has an end portion and a cantilever structure extending toward a first predetermined orientation from the base portion 140. In detail, when the connector 100 is positioned in the closed position, the second spring portion 152 protrudes frontward from the base portion 140 and then extends upward. Moreover, the second spring portion 152 has a thickness in a second predetermined orientation orthogonal to the first predetermined orientation. The second spring portions 152 are coupled together by the second operation portion 154 and the fitting regulated portion 170. The second operation portion 154 couples the end portions of the second spring portions 152 together. When the connector 100 is positioned in the closed position, the fitting regulated portion 170 is located under the second operation portion 154 in the up-down direction. The second operation portion 154 is provided with a recess portion 156. The recess portion 156 is shaped as if a part of the second operation portion 154 is dented in the second predetermined orientation. In other words, the recess portion 156 is recessed rearward when the connector 100 is positioned in the closed position. In the present embodiment, when the connector 100 is positioned in the closed position, the first predetermined orientation coincides with an upward direction while the second predetermined orientation coincides with a rearward direction.

As shown in FIG. 4, the fitting regulated portion 170 is located between the second spring portions 152 in the axis direction and supported by the second spring portions 152. Moreover, the fitting regulated portion 170 is located, as shown in FIG. 13, within the thickness of the second spring portion 152 in the second predetermined orientation. In other words, when the connector 100 is positioned in the closed position, the fitting regulated portion 170 is located within an extent of the second spring portion 152 in the front-rear direction. In the present embodiment, the whole of the fitting regulated portion 170 is located within the thickness of the second spring portion 152 in the second predetermined orientation. However, the present invention is not limited thereto. Only a part of the fitting regulated portion 170 may be located within the extent of the second spring portion 152 in the second predetermined orientation. In other words, it is essential only that the fitting regulated portion 170 has a part thereof located within the thickness of the second spring portion 152 in the second predetermined orientation. The fitting regulated portion 170 is further provided with an abutment surface (a first abutment surface) 172 directed in a third predetermined orientation opposite to the first predetermined orientation or in a composite orientation of the second predetermined orientation and the third predetermined orientation. In other words, the abutment surface 172 has no component directed in a fourth predetermined direction opposite to the second predetermined orientation. In the present embodiment, the abutment surface 172 is directed in the third predetermined orientation. In the present embodiment, when the connector 100 is positioned in the open position, the third predetermined orientation coincides with the rearward direction while the fourth predetermined direction coincides with a downward direction.

As shown in FIG. 4, the second regulated portions 160 have shapes symmetrical to each other. The second regulated portions 160 are located inward of the second spring portions 152 in the axis direction and supported by the second spring portions 152. In detail, the second regulated portions 160 protrude forward from the second spring portions 152 when the connector 100 is positioned in the closed position. As shown in FIG. 13, when the connector 100 is positioned in the open position, the second regulated portion 160 is more protrusive downward than the fitting regulated portion 170.

As understood from FIG. 4, operating the second operation portion 154 allows the second spring portions 152 to be resiliently deformed, and therefore the second regulated portions 160 and the fitting regulated portion 170 can be moved at least in the radial direction of the specific cylindrical coordinates system. In other words, deforming the second spring portions 152 resiliently by operating the second operation portion 154 allows the second regulated portions 160 and the fitting regulated portion 170 to be moved at least in the second predetermined orientation. Thus, the second operation portion 154 can move not only the second regulated portions 160 but also the fitting regulated portion 170.

Figure 18:
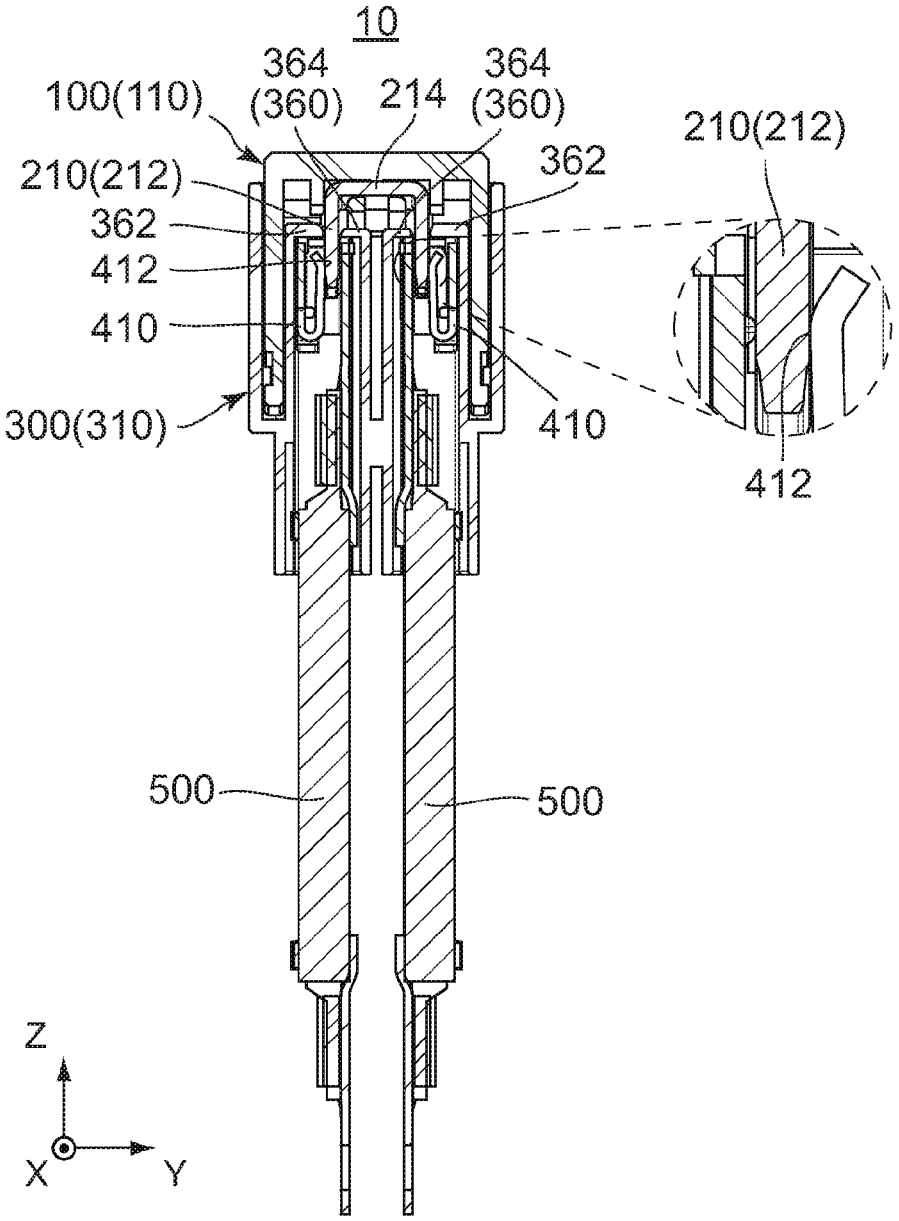
FIG. 18 is a cross-sectional view showing the connector device of FIG. 16, taken along line I-I. A contact of a mating power-supply terminal and a periphery thereof are enlarged and illustrated.
Figure 25:
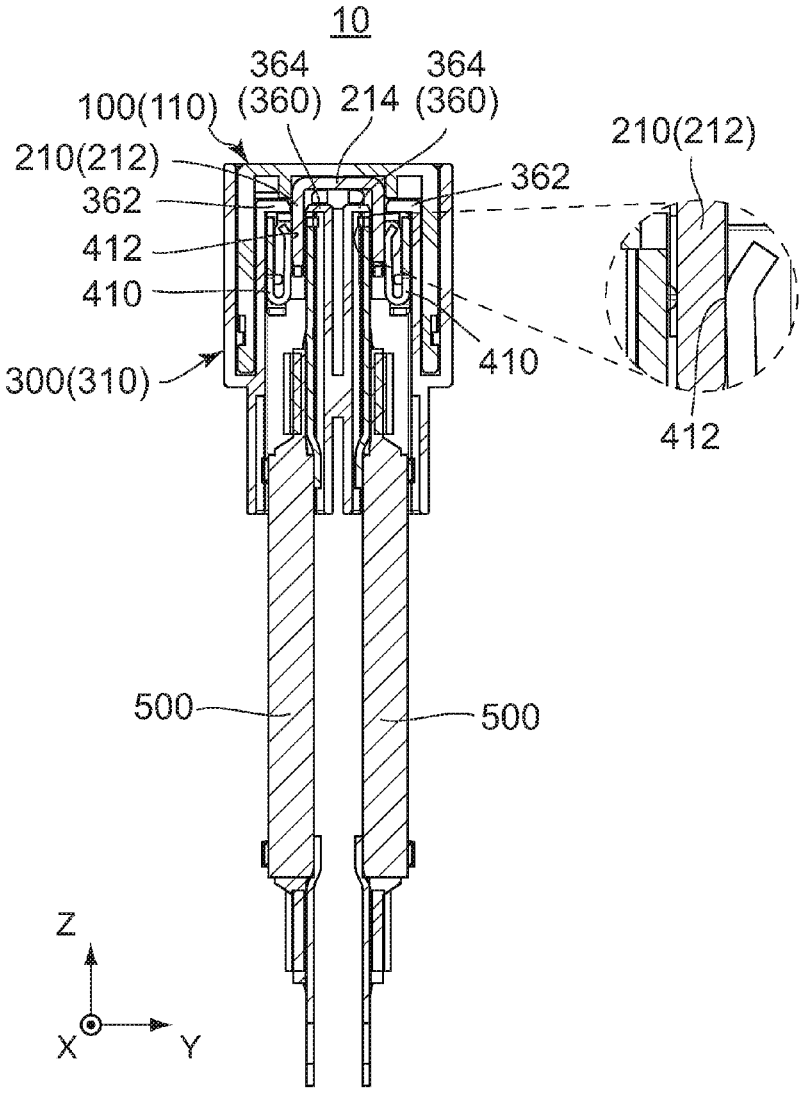
FIG. 25 is a cross-sectional view showing the connector device of FIG. 23, taken along line N-N. The contact of the mating power-supply terminal and the periphery thereof are enlarged and illustrated.
Figure 32:
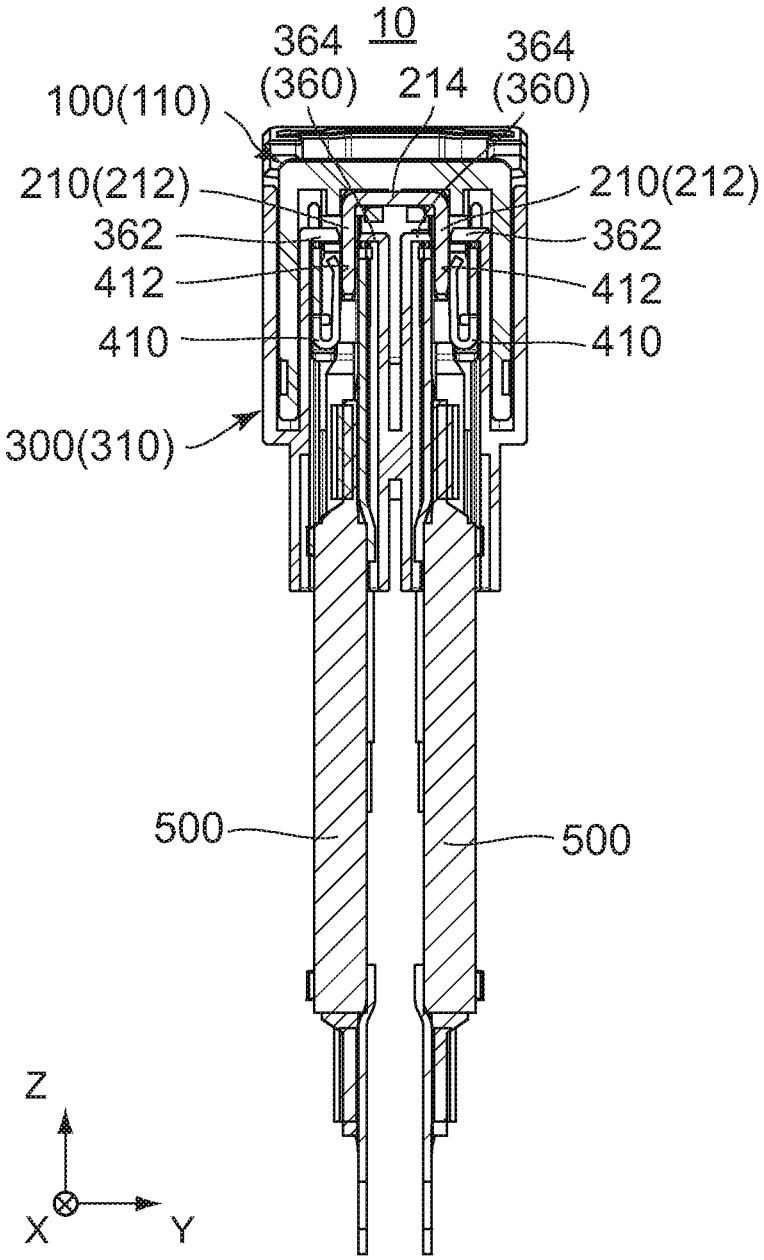
FIG. 32 is a cross-sectional view showing the connector device of FIG. 30, taken along line S-S.

As shown in FIG. 2, the power-supply terminal 210 is provided with two blade portions 212 and a connection portion 214 which couples the blade portions 212 together. As shown in FIGS. 18, 25 and 32, the power-supply terminal 210 is for connecting the mating power-supply terminals 410 to each other. As shown in FIG. 2, the blade portions 212 have shapes symmetrical to each other. Each of the blade portions 212 extends in the orthogonal plane. The blade portion 212 has a distal edge which is chamfered. As understood from FIGS. 11 to 13, the connection portion 214 is attached to and held by the housing 110. Specifically, the power-supply terminal 210 of the present embodiment is fixed to the housing 110 so that it cannot be relatively moved with respect to the housing 110.

As shown in FIG. 2, the detection terminal 230 is provided with two contact portions 232 and a connection portion 234 which couples the contact portions 232 together. As understood from FIGS. 2, 8, and 11 to 13, the detection terminal 230 is held by the housing 110. Unlike the detection terminals of Patent Document 1, the detection terminal 230 of the present embodiment is fixed to the housing 110 so that it cannot be relatively moved with respect to the housing 110.

As understood from FIG. 1, an interval between each of the axis portions 120 and the power-supply terminal 210 is shorter than an interval between each of the axis portions 120 and the detection terminal 230. Consequently, a connection of the power-supply terminal 210 to the mating connector 300 can be performed prior to a connection of the detection terminal 230 to the mating connector 300 without enlarging the size of the whole of the connector device 10.

As understood from FIGS. 1, 8, 15, 22 and 29, when the axis portions 120 and the mating axis portions 320 are combined with one another, the connector 100 becomes rotatable around the rotation axes (the mating axis portions 320) between the open position and the closed position with respect to the mating connector 300. The open position is a position shown in FIG. 8. When the connector 100 is positioned in the open position, the connector 100 is in a standing state. The closed position is a position shown in FIG. 22. When the connector 100 is positioned in the closed position, the connector 100 is in a lying state. As understood from FIGS. 8, 15, 22 and 29, when the connector 100 is positioned between the open position and the closed position, the connector 100 is located above the mating connector 300 in the up-down direction. Referring to FIGS. 10 and 11, the rotation axes (the mating axis portions 320) and the first regulated portions 132 define a first distance between them while the rotation axes and the second regulated portions 160 define a second distance between them. As understood from FIGS. 10 and 11, the first distance is shorter than the second distance.

As understood from FIGS. 2, 5, 10, 17, 24 and 31, when the connector 100 turns between the open position and the closed position, the flange guide portions 122 are located inward of the flanges 322 in the axis direction and face the flanges 322 to guide movement of the flanges 322 in the orthogonal planes. In addition, when the connector 100 is turned, the protrusions of the mating guide portions 380 are moved in the grooves of the guide portions 180 to guide the turn of the connector 100.

Figure 12:
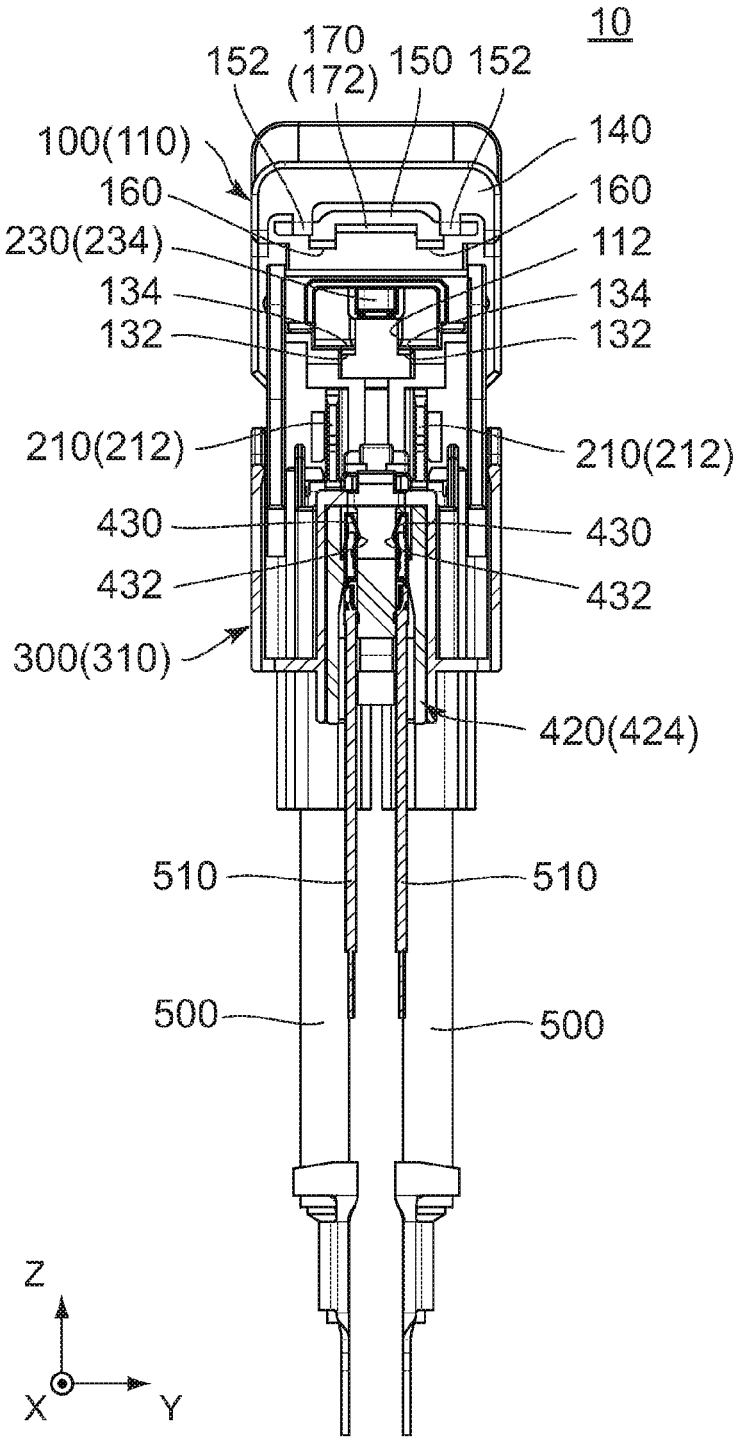
FIG. 12 is a cross-sectional view showing the connector device of FIG. 9, taken along line E-E.

As understood from FIGS. 1 and 8 to 10, the connector 100, which is in the standing state (in the state that a longitudinal direction thereof coincides with the up-down direction), is attached to the mating connector 300 from above of the mating connector 300 along the up-down direction. In this time, the leading portions 124 receive the mating axis portions 320 and guide the mating axis portions 320 to the axis portions 120 along the up-down direction. For that purpose, as shown in FIG. 10, when the connector 100 is positioned in the open position, the leading portion 124 extends along the up-down direction and opens downward. As shown in FIG. 11, when the connector 100 is positioned in the open position, the power-supply terminal 210 is not connected to the mating power-supply terminals 410. In addition, as shown in FIG. 12, the detection terminal 230 is not connected to the mating detection terminals 430.

Figure 20:
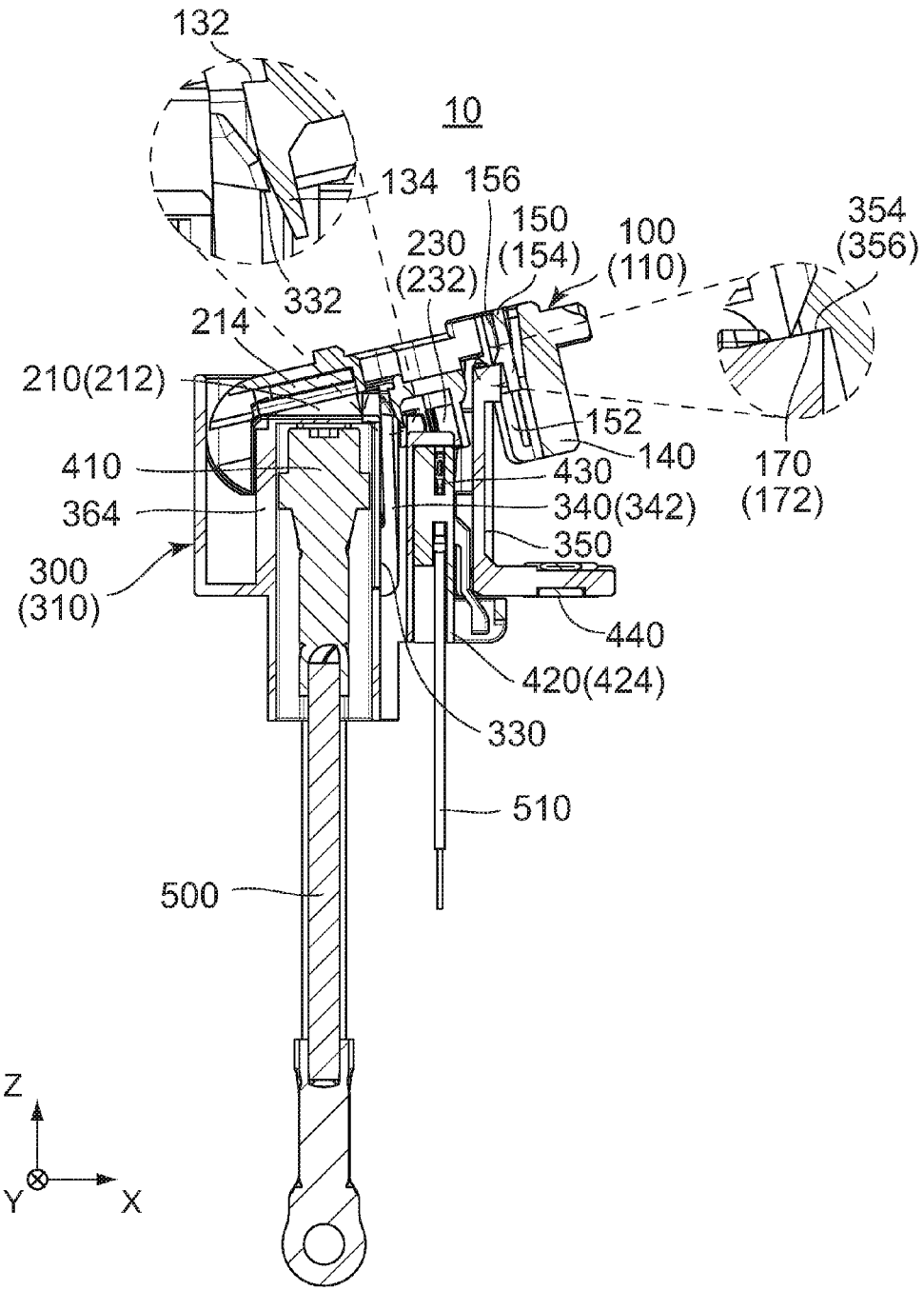
FIG. 20 is a cross-sectional view showing the connector device of FIG. 16, taken along line K-K. The first regulating portion and a periphery thereof and a fitting regulating portion and a periphery thereof are enlarged and illustrated, respectively.

As shown in FIG. 20, when the connector 100 is turned from the open position to an additional predetermined position (a regulation position) located between the open position and the closed position, the fitting regulated portion 170 is brought into abutment with the fitting regulating portion 354 at a position located within the thickness of the second spring portions 152 in the second predetermined orientation. In other words, the part of the fitting regulated portion 170 located within the thickness of the second spring portions 152 in the second predetermined orientation is brought into abutment with the fitting regulating portion 354. As a result, the connector 100 is once regulated so as not to be turned toward the closed position beyond the additional predetermined position. At this time, the abutment surface 172 of the fitting regulated portion 170 faces the abutment surface 356 of the fitting regulating portion 354. As mentioned before, the abutment surface 172 of the fitting regulated portion 170 is directed in the third predetermined orientation or in the composite orientation of the second predetermined orientation and the third predetermined orientation. On the other hand, when the connector 100 is positioned in the additional predetermined position, the abutment surface 356 of the fitting regulating portion 354 is directed in the first predetermined orientation or in a composite orientation of the first predetermined orientation and the fourth predetermined direction opposite to the second predetermined orientation. In other words, the abutment surface 356 has no component directed in the second predetermined orientation. In addition, the fitting regulated portion 170 is located within the thickness of the second spring portions 152 in the second predetermined orientation. Accordingly, when the connector 100 is forced to be turned toward the closed position, the second spring portions 152 are never resiliently deformed in a direction that the fitting regulated portion 170 is slid to release regulation by the fitting regulating portion 354 for the fitting regulated portion 170. Therefore, the connector 100 is maintained in the additional predetermined position until an operation is performed to release the regulation by the fitting regulating portion 354 for the fitting regulated portion 170.

Figure 19:
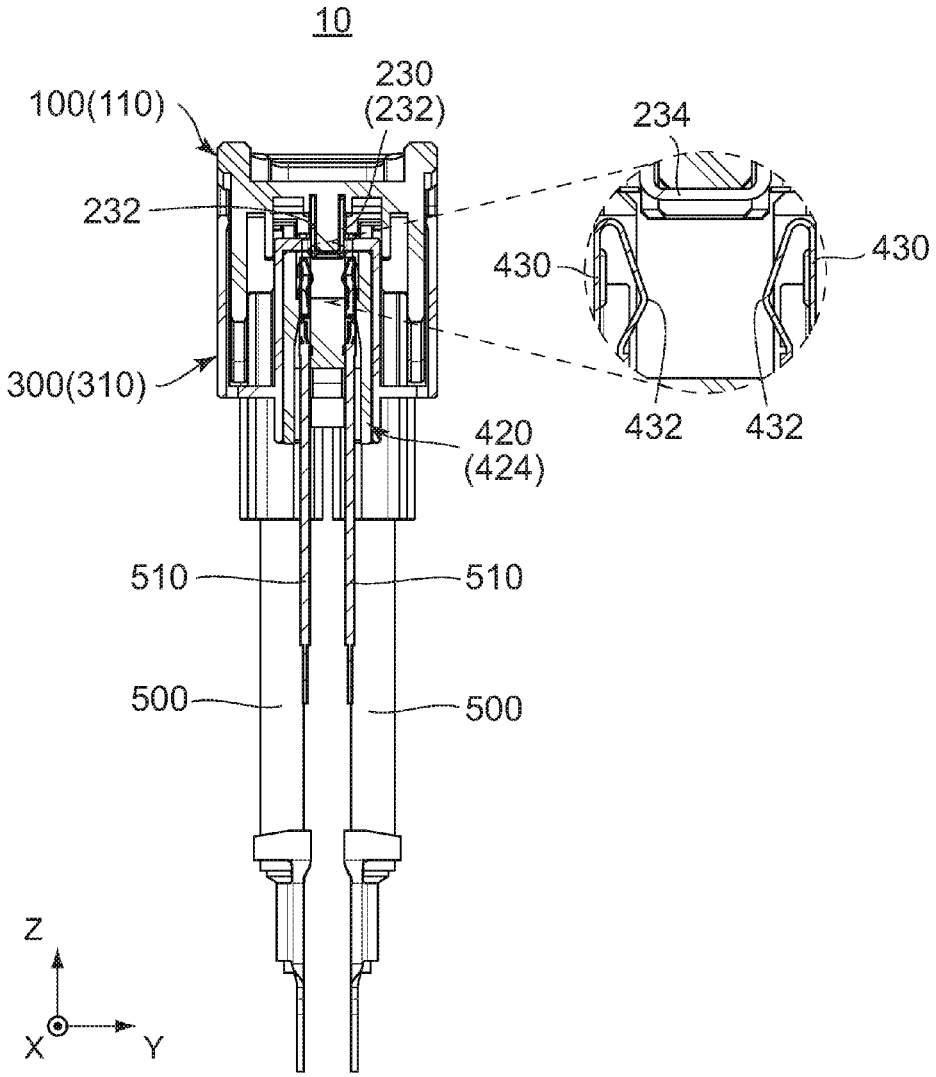
FIG. 19 is a cross-sectional view showing the connector device of FIG. 16, taken along line J-J. Contacts of mating detection terminals and a periphery of them are enlarged and illustrated.

As shown in FIGS. 18 and 19, when the connector 100 is positioned in the additional predetermined position, the power-supply terminal 210 is connected to the mating power-supply terminals 410, but the detection terminal 230 does not reach the mating detection terminals 430. In other words, as shown in FIGS. 15 to 19, when the connector 100 is positioned in the additional predetermined position, the power-supply terminal 210 is connected to the mating power-supply terminals 410, but the detection terminal 230 is not connected to the mating detection terminals 430. Since the detection terminal 230 is not connected to the mating detection terminals 430, the signal lines 510 are disconnected from each other. Consequently, the power-supply system (not shown) can detect that the connector 100 is incompletely fitted with the mating connector 300 and control a current so as not to supply it to the power cables 500 even when the power-supply terminal 210 connects the mating power-supply terminals 410 to each other physically.

As understood from FIGS. 2 and 11, each of the blade portions 212 of the power-supply terminal 210 moves in the orthogonal plane while the connector 100 is turned. Referring to FIGS. 10 and 11, since the flange guide portions 122 guide the flanges 322, the blade portions 212 can move appropriately in the orthogonal planes and reach into the mating power-supply terminals 410.

The edges of the blade portions 212 are chamfered. Therefore, the blade portions 212 are smoothly received in the mating power-supply terminals 410 when the blade portions 212 are connected to the mating power-supply terminals 410. In the present embodiment, the blade portions 212 of the power-supply terminal 210 are in contact with the contacts 412 of the mating power-supply terminals 410 in the axis direction in the mating power-supply terminals 410.

As understood from FIG. 20, when the connector 100 is positioned in the additional predetermined position, the lead portions 134 push the upper surfaces of the first regulating portions 332 and deform the first spring portion 342 resiliently. When the first spring portion 342 is resiliently deformed, the first regulating portions 332 are moved at least forward in comparison with when the connector 100 is positioned in the open position. At this time, the upper surfaces of the first regulated portions 132 are located upward of the lower surfaces of the first regulating portions 332 in the up-down direction. That is, the first regulated portions 132 are not regulated by the first regulating portions 332.

Figure 21:
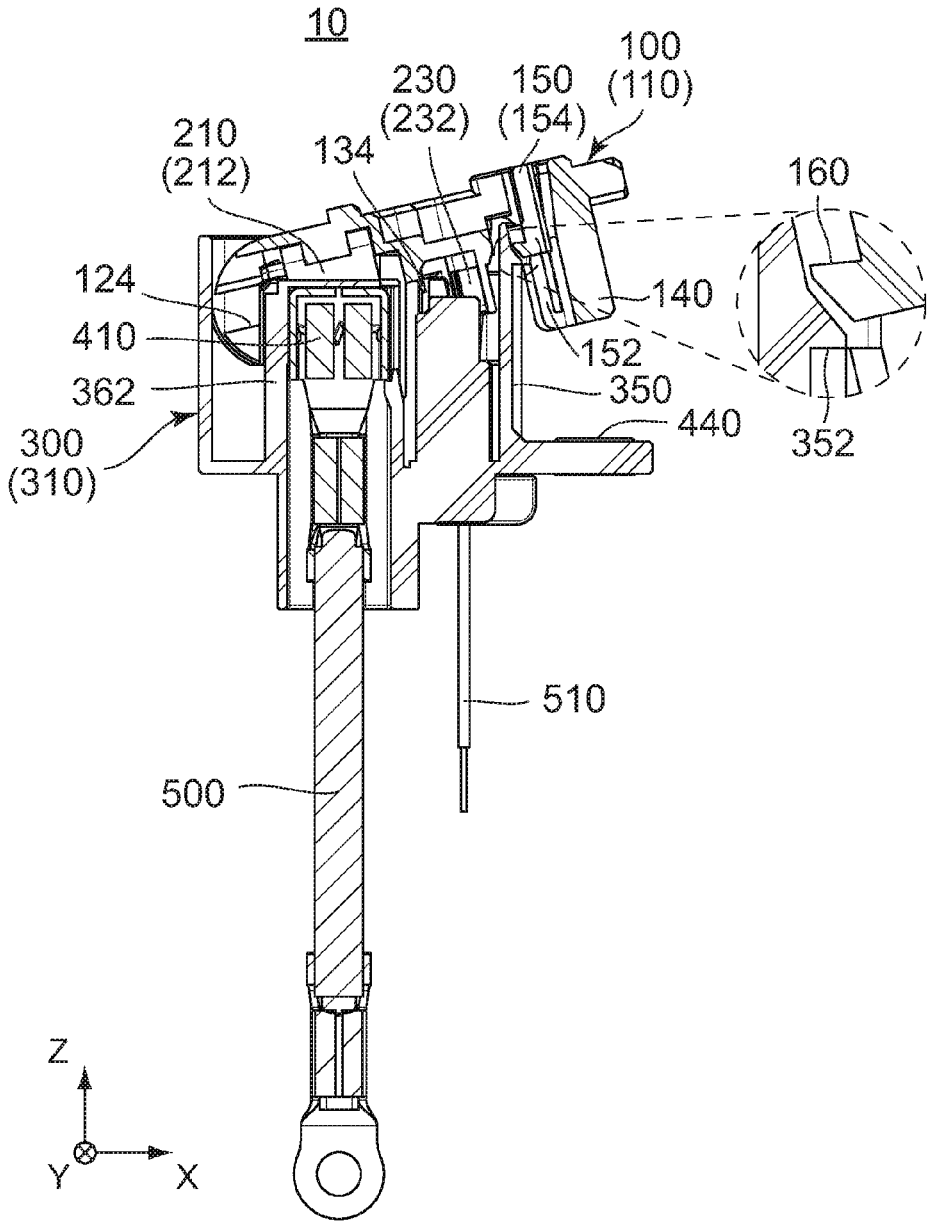
FIG. 21 is a cross-sectional view showing the connector device of FIG. 16, taken along line L-L. A second regulating portion and a periphery thereof are enlarged and illustrated.
Figure 22:
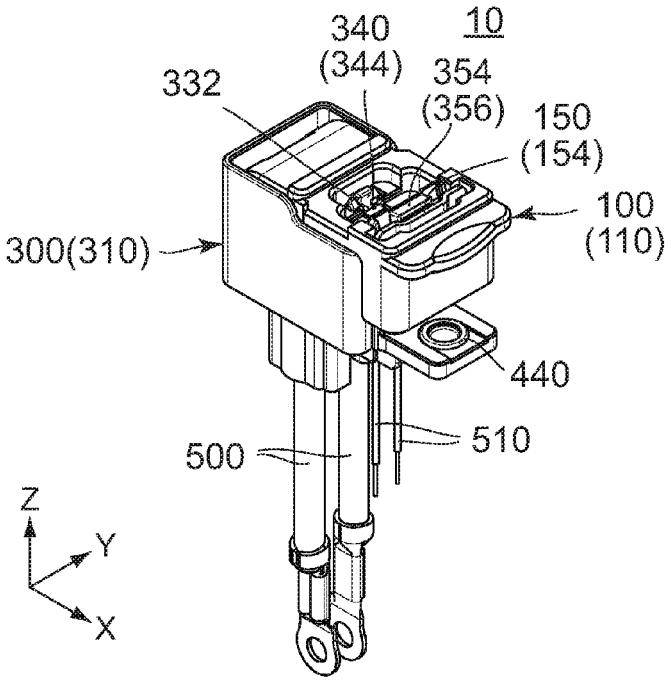
FIG. 22 is yet another perspective view showing the connector device of FIG. 1. The connector is in the closed position.
Figure 23:
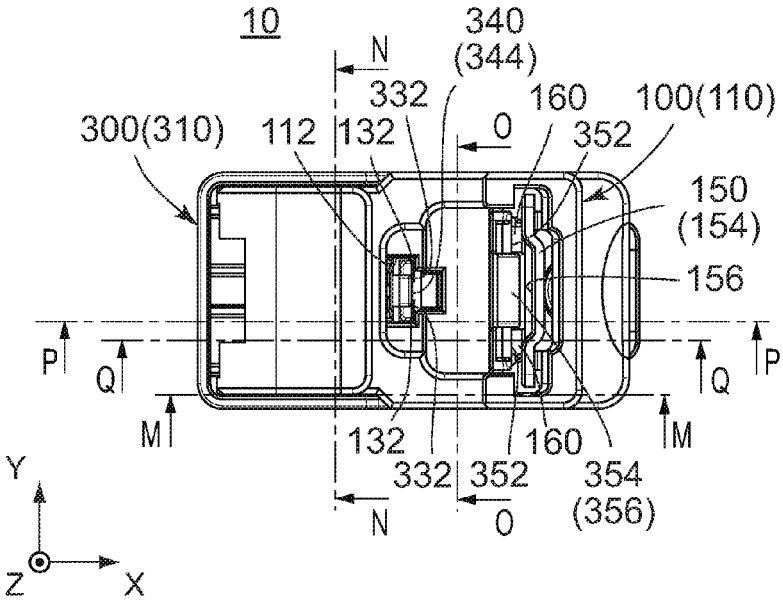
FIG. 23 is a plan view showing the connector device of FIG. 22.
Figure 24:
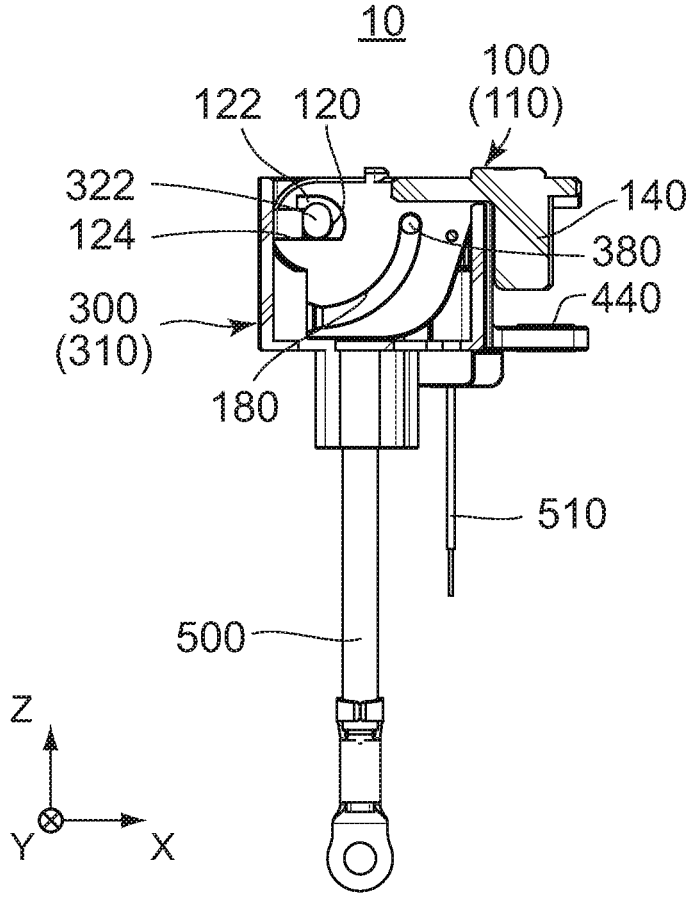
FIG. 24 is a cross-sectional view showing the connector device of FIG. 23, taken along line M-M.

As shown in FIG. 21, when the connector 100 is positioned in the additional predetermined position, upper surfaces of the second regulated portions 160 are located upward of the lower surfaces of the second regulating portions 352 in the up-down direction. That is, the second regulated portions 160 are not regulated by the second regulating portions 352.

As described above with referring to FIG. 20, when the connector 100 is positioned in the additional predetermined position, the fitting regulated portion 170 is brought into abutment with the fitting regulating portion 354, and turning or movement of the connector 100 is temporarily regulated (an additional regulation is performed). As understood from FIG. 20, when the connector 100 is positioned in the additional predetermined position, operating the second operation portion 154 releases the regulation by the fitting regulating portion 354 for the fitting regulated portion 170. In detail, moving the second operation portion 154 outwardly in the radial direction of the specific cylindrical coordinates system deforms the second spring portions 152 resiliently and thereby moving the fitting regulated portion 170 outwardly in a radial direction of turning thereof. As a result, the aforementioned additional regulation is released, and the connector 100 becomes rotatable toward the closed position shown in FIG. 22. Thus, the second release portion 150 also serves as an additional release portion to release the regulation by the fitting regulating portion 354 for the fitting regulated portion 170. That is, the second operation portion 154 serves as an additional operation portion (an operation portion) while the second spring portions 152 serve as a cantilever portion. In other words, the additional operation portion and the cantilever portion form the second release portion 150.

As shown in FIGS. 22 to 26, when the connector 100 is positioned in the closed position, the power-supply terminal 210 and the detection terminal 230 of the connector 100 are connected to the mating power-supply terminals 410 and the mating detection terminals 430, respectively. Accordingly, the power-supply system (not shown) can detect that the connector 100 is completely fitted with the mating connector 300 and control a current so as to supply it to the power cables 500.

In the present embodiment, the power-supply terminal 210 keeps the mating power-supply terminals 410 being connected to each other when the connector 100 is positioned between the additional predetermined position and the closed position. As shown in FIG. 25, when the connector 100 is positioned in the closed position, the power-supply terminal 210 has a sectional shape of an angular inverted U-shape in a plane (a Y-Z plane) orthogonal to the front-rear direction.

Figure 26:
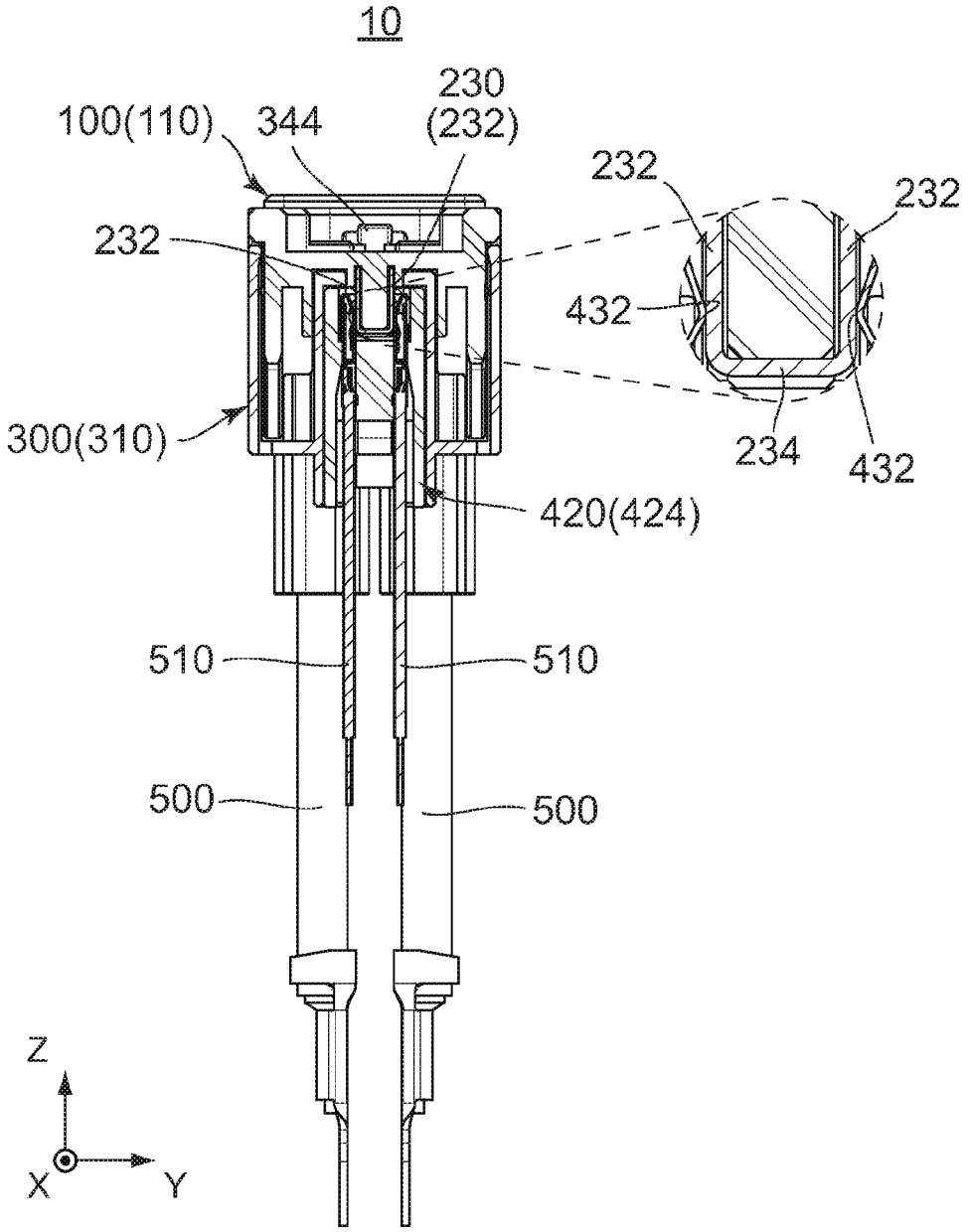
FIG. 26 is a cross-sectional view showing the connector device of FIG. 23, taken along line O-O. The contacts of the mating detection terminals and the periphery of them are enlarged and illustrated.

On the other hand, as understood from FIGS. 19 and 26, the detection terminal 230 is not connected to the mating detection terminals 430 until the connector 100 reaches the closed position. When the connector 100 reaches the closed position, the detection terminal 230 is connected to the contacts 432 of the mating detection terminals 430. Additionally, as shown in FIG. 26, when the connector 100 is positioned in the closed position, the detection terminal 230 has a sectional shape of an angular U-shape in a plane (a Y-Z plane) orthogonal to the front-rear direction.

As understood from FIGS. 20 and 27, the first regulated portions 132 ride over the first regulating portions 332 and are moved downward of the first regulating portions 332 in the up-down direction while the connector 100 is moved or turned from the additional predetermined position to the closed position. As shown in FIG. 27, when the connector 100 is positioned in the closed position, the first regulated portion 132 is located downward of the first regulating portion 332 in the up-down direction. As understood from FIG. 27, the first regulated portions 132 overlap the first regulating portions 332 when seen along the up-down direction. With this structure, when the connector 100 is turned toward a predetermined position from the closed position, the first regulated portions 132 are brought into abutment with the first regulating portions 332, and the connector 100 is regulated so as not to reach the predetermined position. Here, the predetermined position is a position shown in FIGS. 29 to 36. In detail, the predetermined position is located between the open position and the closed position, in more detail, between the additional predetermined position and the closed position. It should be noted that there is a clearance between the first regulating portion 332 and the first regulated portion 132 in FIG. 27. However, the first regulating portions 332 and the first regulated portions 132 may be in contact with one another when the connector 100 is positioned in the closed position. In that case, the connector 100 cannot be turned toward the predetermined position beyond the closed position. As a result, looseness of the connector 100 to the mating connector 300 is suppressed.

Figure 28:
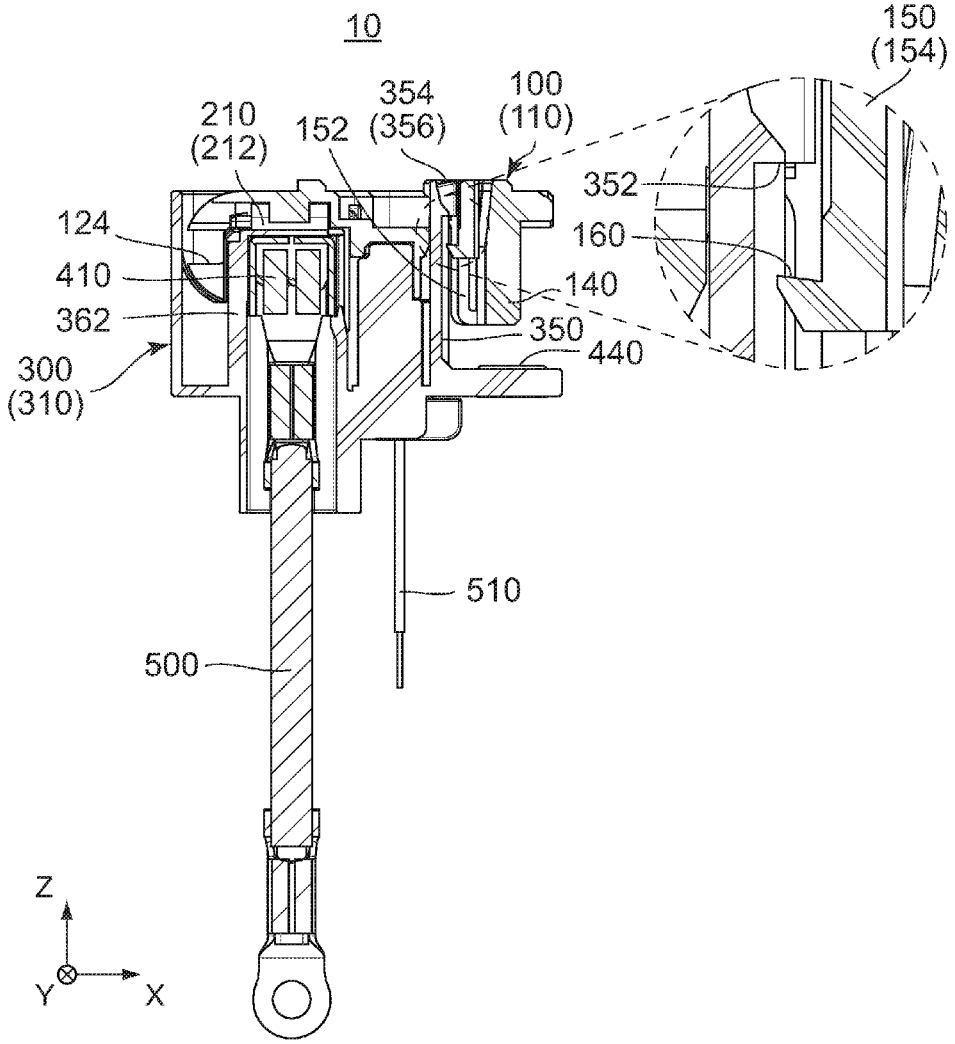
FIG. 28 is a cross-sectional view showing the connector device of FIG. 23, taken along line Q-Q. The second regulating portion and the periphery thereof are enlarged and illustrated.
Figure 29:
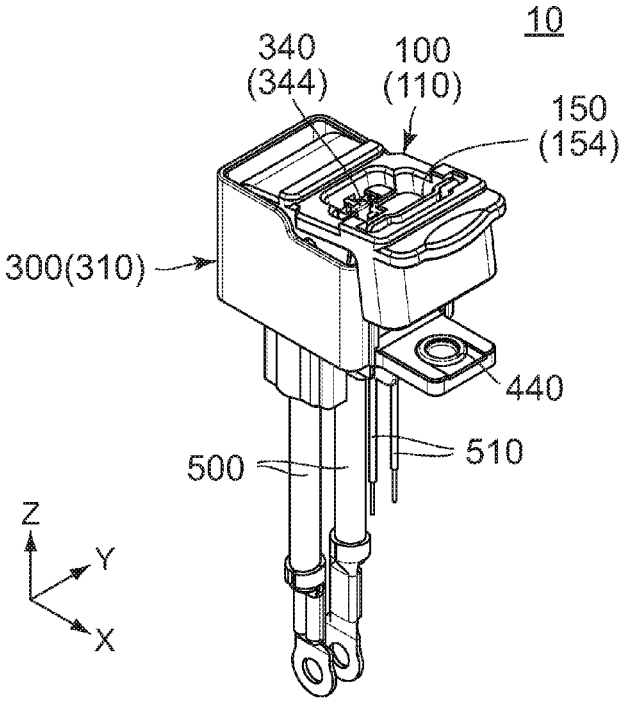
FIG. 29 is further another perspective view showing the connector device of FIG. 1. The connector is in a predetermined position.

As understood from FIGS. 21 to 28, while the connector 100 is turned from the additional predetermined position to the closed position, the second regulated portions 160 are moved downward of the second regulating portions 352 in the up-down direction beyond the second regulating portions 352 using resilient deformation of the second spring portions 152. As shown in FIG. 28, in a case where the connector 100 is positioned in the closed position, the second regulated portion 160 overlaps the second regulating portion 352 when seen along the up-down direction. With this structure, when the connector 100 is turned toward the predetermined position from the closed position, the second regulated portions 160 are brought into abutment with the second regulating portions 352, and the connector 100 is regulated so as not to be turned toward the open position. The regulation by the second regulating portions 352 for the second regulated portions 160 regulates that the connector 100 is turned toward the open position beyond the predetermined position.

As shown in FIG. 27, when the connector 100 is positioned in the closed position, the first spring portion 342 extends upward from the inner wall portion 330 while the first operation portion 344 is located at the upper end of the first spring portion 342. As understood from FIGS. 23 and 26, though the first operation portion 344 protrudes upward from the opening 112 of the housing 110, it is located downward of an upper edge of the housing 110 in the up-down direction. Accordingly, the first operation portion 344 can be operated intentionally and can be prevented from being operated by accident.

As shown in FIGS. 27 and 28, when the connector 100 is positioned in the closed position, the second spring portion 152 extends upward from the base portion 140 while the second operation portion 154 is located at an upper end (a second upper end) of the second spring portions 152. As understood from FIGS. 23, 27 and 28, the second operation portion 154 is almost screened by the fitting regulating portion 354 when seen from the rear along the front-rear direction. Accordingly, the second operation portion 154 is difficult to be operated when the connector 100 is positioned in the closed position.

As understood from FIG. 27, in order to turn the connector 100 from the closed position to the open position, at first, the first release portion 340 is operated to release the regulation by the first regulating portions 332 for the first regulated portions 132. In detail, the first operation portion 344 is moved inward in the radial direction of turning of the connector 100 to deform the first spring portion 342 resiliently. Then, the regulation by the first regulating portions 332 for the first regulated portions 132 is released. In other words, moving the first operation portion 344 forward deforms the first spring portion 342 resiliently, and the first regulating portions 332 is moved at least forward. Accordingly, the regulation by the first regulating portions 332 for the first regulated portions 132 is released. In a state that the regulation by the first regulating portions 332 for the first regulated portions 132 is released, the connector 100 can be turned toward the open position from the closed position.

As understood from FIGS. 27, 28, 34 and 35, after the regulation by the first regulating portions 332 for the first regulated portions 132 is released, when the connector 100 is turned toward the open position, the second regulated portions 160 are brought into abutment with the second regulating portions 352 in the predetermined position. Hence, the connector 100 is regulated so as not to be turned toward the open position beyond the predetermined position. As understood from FIG. 35, at this time, the second regulated portions 160 are located upward of fixed ends of the second spring portions 152. The fixed ends are boarder parts between the second spring portions 152 and the base portion 140. Furthermore, the second regulated portions 160 are located inward of the fixed ends of the second spring portions 152 in the radial direction of the specific cylindrical coordinates system. Therefore, when the connector 100 is forced to be turned toward the open position, the second spring portions 152 are resiliently deformed to move the second regulated portions 160 inward in the radial direction of the specific cylindrical coordinates system. As a result, the second regulated portions 160 are strongly caught by the second regulating portions 352. Then, it is possible to avoid accidental release of the regulation by the second regulating portions 352 for the second regulated portions 160.

Figure 34:
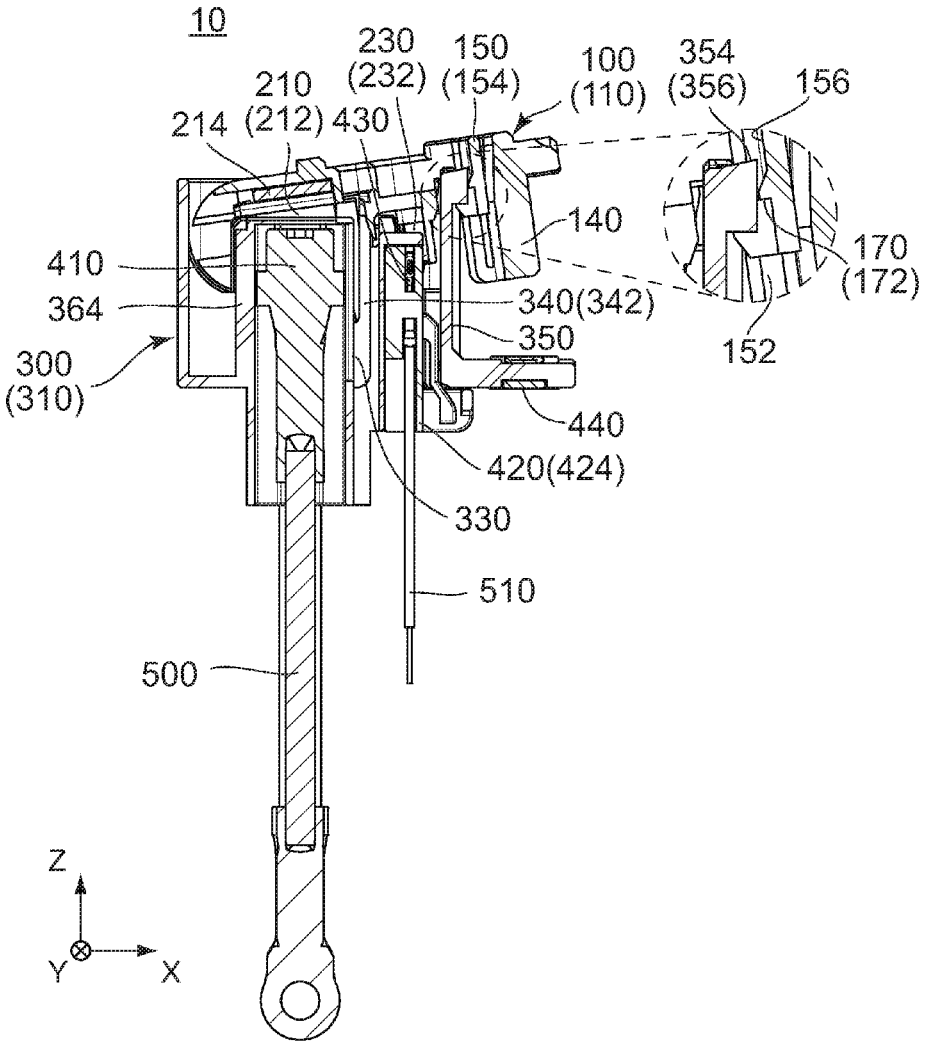
FIG. 34 is a cross-sectional view showing the connector device of FIG. 30, taken along line U-U. The fitting regulating portion and the periphery thereof are enlarged and illustrated.
Figure 35:
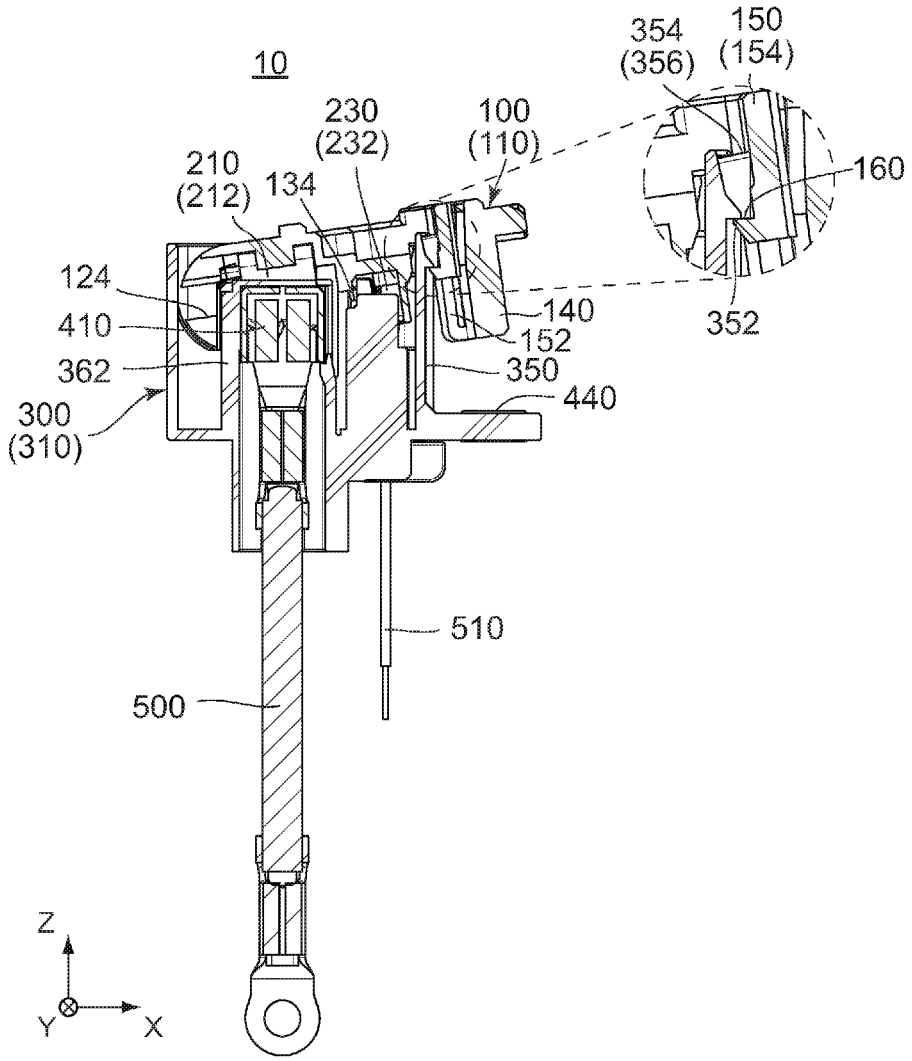
FIG. 35 is a cross-sectional view showing the connector device of FIG. 30, taken along line V-V. The second regulating portion and the periphery thereof are enlarged and illustrated.
Figure 36:
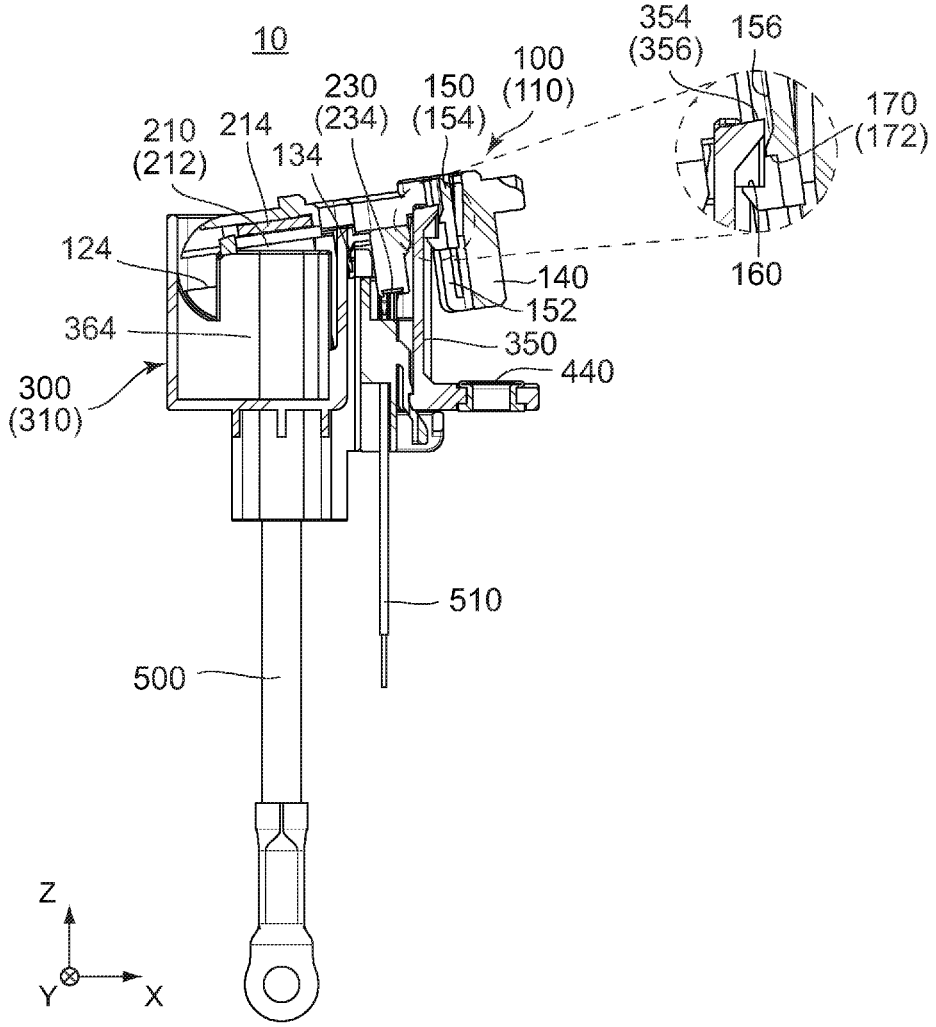
FIG. 36 is a cross-sectional view showing the connector device of FIG. 30, taken along line W-W. The fitting regulating portion and the periphery thereof are enlarged and illustrated.
Figure 37A:
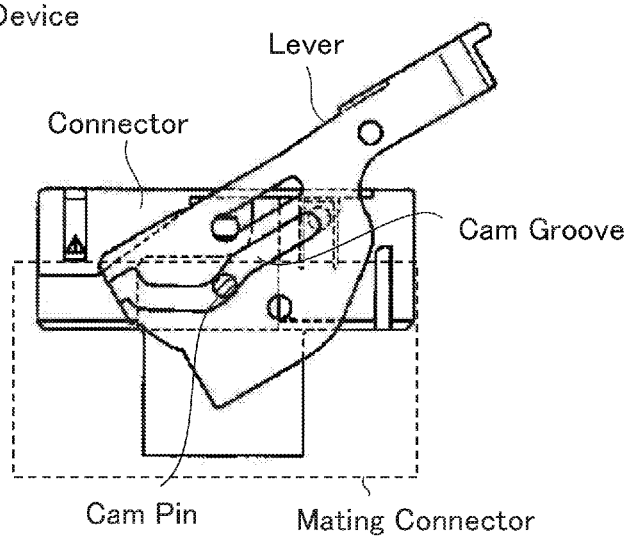
FIG. 37A PRIOR ART
FIG. 37A is a side view showing a lever fitting type power source circuit interruption device (a connector device) of Patent Document 1. In the drawing, a connector is depicted by a solid line while a mating connector is depicted by a broken line.
Figure 37B:
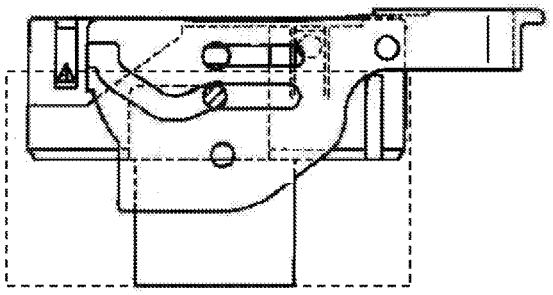
FIG. 37B PRIOR ART
FIG. 37B is another side view showing the lever fitting type power source circuit interruption device of FIG. 37A.
Figure 37C:
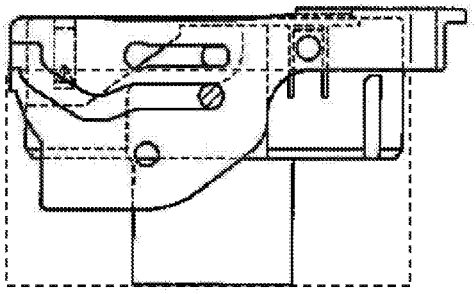
FIG. 37C PRIOR ART
FIG. 37C is further another side view showing the lever fitting type power source circuit interruption device of FIG. 37A.

As understood from FIGS. 28 and 35, when the connector 100 is turned toward the predetermined position from the closed position, the second operation portion 154 is moved toward the fitting regulating portion 354. In this event, if the fitting regulating portion 354 comes into contact with the second operation portion 154, the second spring portions 152 receives a force directed outward in the radial direction of the specific cylindrical coordinates system. The force works to deform the second spring portions 152 resiliently in a direction that the regulation by the second regulating portions 352 for the second regulated portions 160 is released. As understood from FIGS. 34 to 36, the recess portion 156 of the second operation portion 154 accommodates at least a part of the fitting regulating portion 354 when the connector 100 is positioned in the predetermined position. With this, the recess portion 156 prevents the fitting regulating portion 354 and the second operation portion 154 from coming into contact with each other and prevents the second spring portions 152 from being resiliently deformed.

Figure 33:
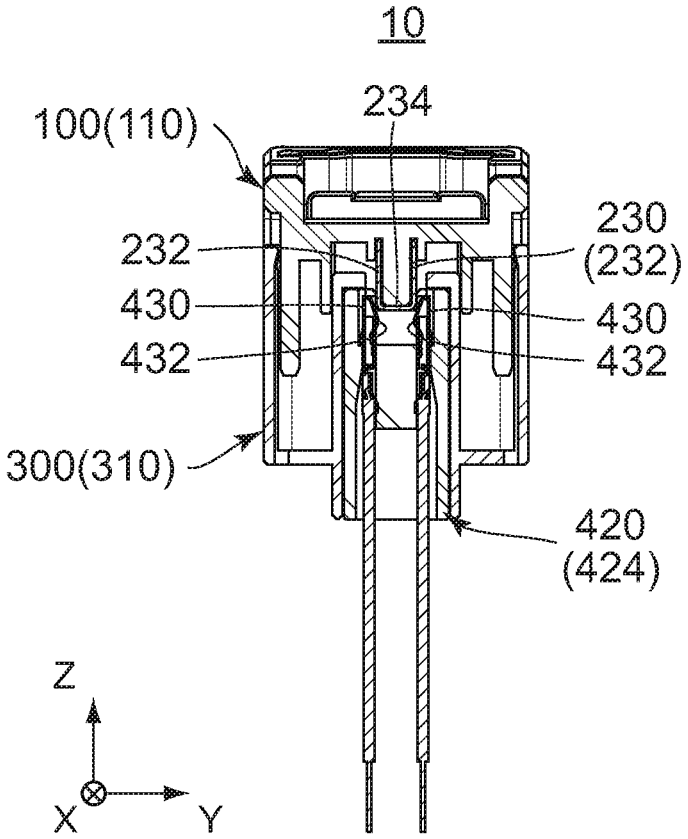
FIG. 33 is a cross-sectional view showing the connector device of FIG. 30, taken along line T-T.

As understood from FIG. 33, while the connector 100 is turned from the closed position to the predetermined position, the detection terminal 230 is disconnected from the mating detection terminals 430. On the other hand, as shown in FIG. 32, the power-supply terminal 210 remains to be connected to the mating power-supply terminals 410. Since the detection terminal 230 is disconnected from the mating detection terminals 430, the power-supply system (not shown) can control to stop supplying a current to the power cables 500.

Figure 30:
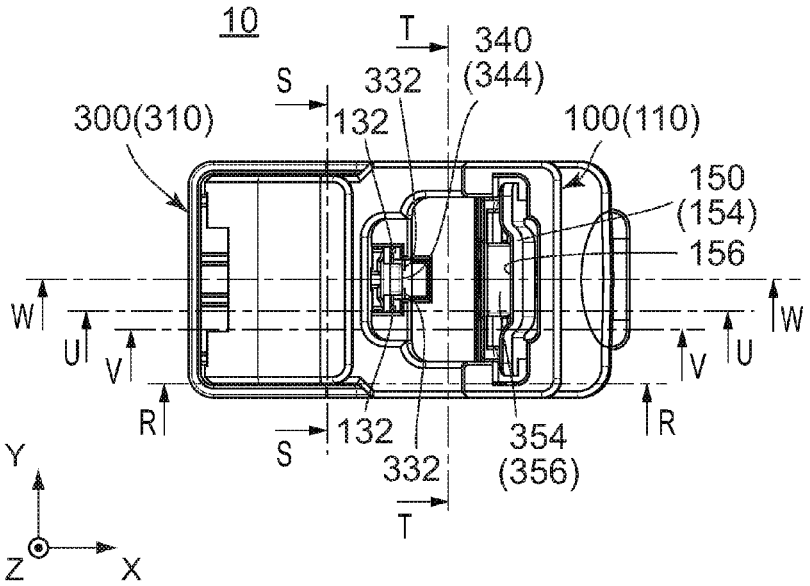
FIG. 30 is a plan view showing the connector device of FIG. 29.
Figure 31:
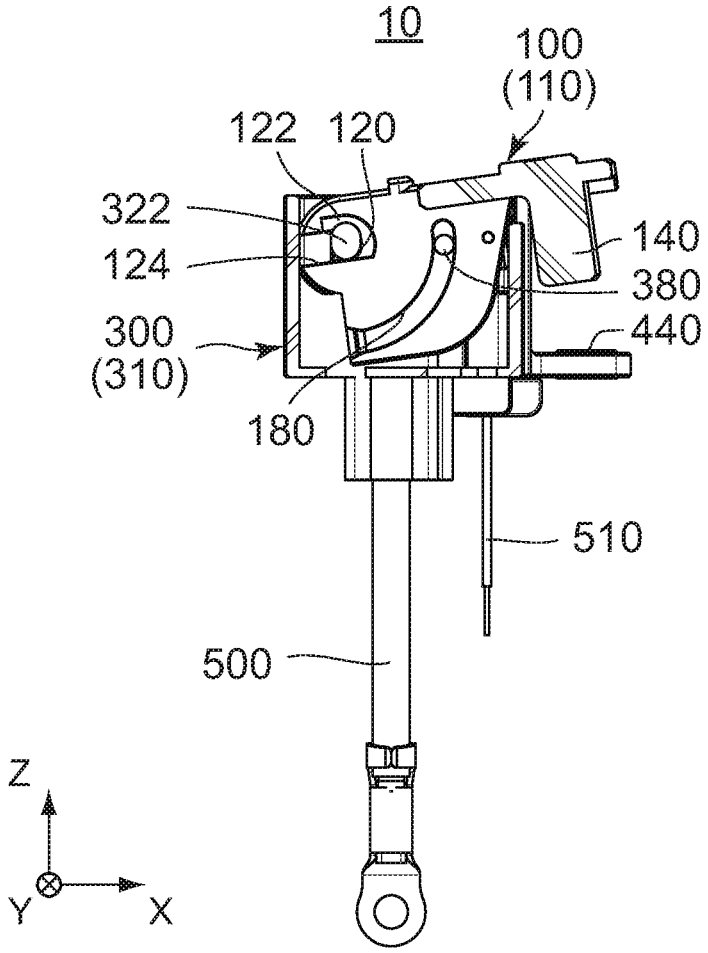
FIG. 31 is a cross-sectional view showing the connector device of FIG. 30, taken along line R-R.

As understood from FIGS. 30, 34 and 35, when the connector 100 is turned toward the predetermined position from the closed position, the second operation portion 154 becomes located upward of the fitting regulating portion 354 in the up-down direction. In other words, when the second operation portion 154 is seen from the front along the front-rear direction, a visible area of the second operation portion 154 is increased as the connector 100 is turned toward the predetermined position from the closed position. In other words, an operable portion of the second release portion 150 is larger when the connector 100 is positioned in the predetermined position in comparison with when the connector 100 is positioned in the closed position. In detail, the operable portion has a first extent when the connector 100 is positioned in the closed position. The operable portion has a second extent when the connector 100 is positioned in the predetermined position. The second extent is larger than the first extent. Consequently, the second operation portion 154 is easy to be operated when the connector 100 is positioned in the predetermined position in comparison with when the connector 100 is positioned in the closed position.

As understood from FIG. 35, in order to turn the connector 100 toward the open position from the predetermined position, the second release portion 150 is operated to release the regulation by the second regulating portions 352 for the second regulated portions 160. In detail, the second operation portion 154 is moved outward in the radial direction of the turning of the connector 100 to deform the second spring portions 152 resiliently. Then, the regulation by the second regulating portions 352 for the second regulated portions 160 is released, and the connector 100 can be further turned toward the open position. Here, an outward direction in the radial direction of the turning of the connector 100 can be divided into a rearward direction component in the front-rear direction and an upward direction component in the up-down direction. As understood from FIGS. 10, 17 and 31, in the present embodiment, the predetermined position is considerably closer to the closed position than the open position. Accordingly, when the connector 100 is positioned in the predetermined position, the rearward direction component is considerably larger than the upward direction component. Therefore, when the second operation portion 154 is operated in a state that the second regulated portions 160 are regulated by the second regulating portions 352, the regulation by the second regulating portions 352 for the second regulated portions 160 can be released by moving the second operation portion 154 in such a way so as to move it rearward. Thus, the connector 100 can be turned to the open position beyond the predetermined position. While the connector 100 is turned to the open position beyond the predetermined position, the fitting regulated portion 170 rides over the fitting regulating portion 354 and to be moved toward the open position. In the middle of the turning of the connector 100 from the predetermined position to the open position, the power-supply terminal 210 is disconnected from the mating power-supply terminals 410.

As mentioned above, in the connector device 10 of the present embodiment, in order to turn the connector 100 from the closed position to the open position, the operation of the first release portion 340 and the operation of the second release portion 150 must be separately carried out. Specifically, in the present embodiment, the operation of the first release portion 340 and the operation of the second release portion 150 are different from each other in direction. Accordingly, a time difference can be certainly generated between the operation of the first release portion 340 and the operation of the second release portion 150. Thus, in the connector device 10 according to the present embodiment, a sufficient time is certainly obtained between a timing of disconnection of the detection terminal 230 and another timing of disconnection of the power-supply terminal 210.

Although the specific explanation about the present invention is made above referring to the embodiments, the present invention is not limited thereto, and other and further modifications may be made thereto.

In the aforementioned embodiment, the first release portion 340 moves the first regulating portions 332 to release the regulation by the first regulating portions 332 for the first regulated portions 132. However, the first release portion 340 may move the first regulated portions 132 to release the regulation by the first regulating portions 332 for the first regulated portions 132. In such a case, the first release portion 340 may be provided to the connector 100. Moreover, in the aforementioned embodiment, the second release portion 150 moves the second regulated portions 160 to release the regulation by the second regulating portions 352 for the second regulated portions 160. However, the second release portion 150 may move the second regulating portions 352 to release the regulation by the second regulating portions 352 for the second regulated portions 160. In such a case, the second release portion 150 is provided to the mating connector 300. At any rate, it is sufficient that one of the first release portion 340 and the second release portion 150 is provided to one of the connector 100 and the mating connector 300 while the other of the first release portion 340 and the second release portion 150 is provided to the other of the connector 100 and the mating connector 300. Alternatively, both of the first release portion 340 and the second release portion 150 may be provided to the connector 100 or the mating connector 300.

In the aforementioned embodiment, the first regulating portions 332, the first regulated portions 132 and the first release portion 340 are designed so that moving the first operation portion 344 forward releases the regulation by the first regulating portions 332 for the first regulated portions 132. However, the first regulating portions 332, the first regulated portions 132 and the first release portion 340 may be designed so that moving the first operation portion 344 rearward to release the regulation by the first regulating portions 332 for the first regulated portions 132. Similarly, in the aforementioned embodiment, the second regulating portions 352, the second regulated portions 160 and the second release portion 150 are designed so that moving the second operation portion 154 rearward releases the regulation by the second regulating portions 352 for the second regulated portions 160. However, the second regulating portions 352, the second regulated portions 160 and the second release portion 150 may be designed so that moving the second operation portion 154 forward releases the regulation by the second regulating portions 352 for the second regulated portions 160. The first operation portion 344 and the second operation portion 154, however, are difficult to be operated when they are designed to be operated in directions away from each other in comparison with when they are designed to be operated in the same direction. Accordingly, when the first operation portion 344 and the second operation portion 154 are designed to be operated in the directions away from each other, a sufficient time is easy to be generated to ensure safety.

In the aforementioned embodiment, the fitting regulating portion 354 and the fitting regulated portion 170 are designed so that the second release portion 150 also serves as the additional release portion. However, the fitting regulating portion 354 and the fitting regulated portion 170 may be designed so that the first release portion 340 also serves as the additional release portion or that the additional release portion may be provided independently. In addition, the additional release portion may be provided to the connector 100 or the mating connector 300. It is desirable, however, that the second release portion 150 also serves as the additional release portion. This is because not only it is possible to avoid the structure from complicating but also the fitting regulated portion 170 can be located in a position more apart from the rotation axes. Locating the fitting regulated portion 170 away from the rotation axes allows the fitting regulating portion 354 and the fitting regulated portion 170 to avoid working a strong force therebetween when the connector 100 is regulated.

In the aforementioned embodiment, three regulations, i.e. the regulation by the first regulating portions 332 for the first regulated portions 132, the regulation by the second regulating portions 352 for the second regulated portions 160 and the regulation by the fitting regulating portion 354 for the fitting regulated portion 170, are performed. However, any one of the regulations may be omitted. For example, when an emphasis is attached on the regulation by the fitting regulating portion 354 for the fitting regulated portion 170, the regulation by the first regulating portions 332 for the first regulated portions 132 may be omitted. Alternatively, when an emphasis is attached on the regulation by the second regulating portions 352 for the second regulated portions 160, the regulation by the fitting regulating portion 354 for the fitting regulated portion 170 may be omitted. In addition, in place of the omission of any one of the regulations, the regulation may be easily released by giving a strong force to turn the connector 100.

In the aforementioned embodiment, the axis portions 120 are the bearings while the mating axis portions 320 are the rotation axes. However, the present invention is not limited thereto. The axis portions 120 may be rotation axes while the mating axis portions 320 may be bearings.

In the aforementioned embodiment, the guide portions 180 are the arc-shaped grooves while the mating guide portions 380 are the protrusions. However, the present invention is not limited thereto. The guide portions 180 may be protrusions while the mating guide portions 380 may be grooves.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector device comprising a connector and a mating connector which is mateable with the connector, wherein:

the connector comprises a housing, a power-supply terminal and a detection terminal;

the housing is formed with an axis portion;

the power-supply terminal and the detection terminal are held by the housing;

the mating connector comprises a mating housing, a mating power-supply terminal and a mating detection terminal;

the mating housing is formed with a mating axis portion;

one of the axis portion and the mating axis portion is a rotation axis with an axis direction while a remaining one of the axis portion and the mating axis portion is a bearing;

when the axis portion and the mating axis portion are combined, the connector is rotatable around the rotation axis between an open position and a closed position with respect to the mating connector;

the mating power-supply terminal and the mating detection terminal are held by the mating housing;

when the connector is positioned between the open position and the closed position, the connector is located above the mating connector in an up-down direction orthogonal to the axis direction of the rotation axis;

when the connector is positioned in the open position, the power-supply terminal is not connected to the mating power-supply terminal while the detection terminal is not connected to the mating detection terminal;

when the connector is positioned in a predetermined position located between the open position and the closed position, the power-supply terminal is connected to the mating power-supply terminal while the detection terminal is not connected to the mating detection terminal;

when the connector is positioned in the closed position, the power-supply terminal and the detection terminal are connected to the mating power-supply terminal and the mating detection terminal, respectively;

the housing is provided with a first regulated portion and a second regulated portion;

the mating housing is provided with a first regulating portion and a second regulating portion;

one of the housing and the mating housing is provided with a first release portion;

one of the housing and the mating housing is provided with a second release portion;

when the connector is turned from the closed position toward the predetermined position, the first regulated portion is brought into abutment with the first regulating portion and regulated to prevent the connector from reaching the predetermined position;

when the first release portion is operated, regulation by the first regulating portion for the first regulated portion is released;

when the connector is turned toward the predetermined position after releasing the regulation for the first regulated portion, the second regulated portion is brought into abutment with the second regulating portion and regulated to prevent the connector from being turned toward the open position beyond the predetermined position; and when the second release portion is operated, regulation by the second regulating portion for the second regulated portion is released.

2. The connector device as recited in claim 1, wherein when the connector is positioned in the closed position, the first regulated portion is in contact with the first regulating portion, so that the connector cannot turn toward the predetermined position beyond the closed position.

3. The connector device as recited in claim 1, wherein the first release portion is provided on one of the housing and the mating housing while the second release portion is provided on a remaining one of the housing and the mating housing.

4. The connector device as recited in claim 3, wherein:

the rotation axis and the first regulated portion define a first distance therebetween;

the rotation axis and the second regulated portion define a second distance therebetween;

the first distance is shorter than the second distance;

the second release portion has an operable portion;

the operable portion has a first extent when the connector is positioned in the closed position;

the operable portion has a second extent when the connector is positioned in the predetermined position; and the second extent is larger than the first extent.

5. The connector device as recited in claim 4, wherein:

the first release portion is provided on the mating housing;

the first release portion has a first spring portion and a first operation portion, the first spring portion has a first upper end;

the first operation portion is located on the first upper end of the first spring portion;

the first regulating portion is supported by the first spring portion;

the second release portion is provided on the housing;

the second release portion has a second spring portion and a second operation portion;

the second spring portion has a second upper end;

when the connector is positioned in the closed position, the second operation portion is located on the second upper end of the second spring portion; and the second regulated portion is supported by the second spring portion.

6. The connector device as recited in claim 5, wherein when the second operation portion is moved outward in a radial direction of turning of the connector to deform the second spring portion resiliently, the regulation by the second regulating portion for the second regulated portion is released.

7. The connector device as recited in claim 6, wherein when the first operation portion is moved inward in the radial direction of the turning of the connector to deform the first spring portion resiliently, the regulation by the first regulating portion for the first regulated portion is released.

8. The connector device as recited in claim 1, wherein:

the housing is provided with a base portion, a cantilever portion which is resiliently deformable, an additional regulated portion and an additional operation portion;

the cantilever portion extends from the base portion in a first predetermined orientation and has a thickness in a second predetermined orientation orthogonal to the first predetermined orientation;

the additional regulated portion and the additional operation portion are supported by the cantilever portion;

the additional regulated portion has a portion which is located within the thickness of the cantilever portion in the second predetermined orientation;

when the cantilever portion is resiliently deformed, the additional regulated portion is moved at least in the second predetermined orientation;

the mating housing is provided with an additional regulating portion;

when the connector is turned from the open position to an additional predetermined position which is located between the open position and the predetermined position, the portion of the additional regulated portion located within the thickness of the cantilever portion is brought into abutment with the additional regulating portion and regulated to prevent the connector from being turned toward the closed position beyond the additional predetermined position;

when the connector is positioned in the additional predetermined position, the power-supply terminal is connected to the mating power-supply terminal while the detection terminal is not connected to the mating detection terminal; and when the additional operation portion is operated to deform the cantilever portion resiliently, regulation by the additional regulating portion for the additional regulated portion is released.

9. The connector device as recited in claim 8, wherein:

the additional regulated portion is provided with a first abutment surface;

the first abutment surface is oriented in a third predetermined orientation opposite to the first predetermined orientation or in a composite orientation of the second predetermined orientation and the third predetermined orientation;

the additional regulating portion is provided with a second abutment surface, when the connector is positioned in the additional predetermined position, the second abutment surface is oriented in the first predetermined orientation or a composite orientation of the first predetermined orientation and a fourth predetermined orientation opposite to the second predetermined orientation; and when the additional regulated portion is brought into abutment with the additional regulating portion, the first abutment surface faces the second abutment surface.

10. The connector device as recited in claim 8, wherein:

the second regulated portion is supported by the cantilever portion;

the additional operation portion and the cantilever portion form the second release portion; and when the additional operation portion is operated to deform the cantilever portion resiliently in a state that the second regulating portion regulates the second regulated portion, the regulation by the second regulating portion for the second regulated portion is released.

11. The connector device as recited in claim 10, wherein the connector is provided with a recess portion which receives the additional regulating portion at least in part to prevent the cantilever portion from being deformed when the connector is positioned in the predetermined position.

12. The connector device as recited in claim 1, wherein:

the housing is provided with a guided portion;

the mating housing is provided with a guide portion;

one of the guided portion and the guide portion is a protrusion while a reaming one of the guided portion and the guide portion is a groove having an arc shape; and when the connector is turned, the protrusion is moved in the groove to guide turning of the connector.

13. The connector device as recited in claim 1, wherein:

the axis portion is the bearing;

the mating axis portion is the rotation axis;

the housing is formed with a leading portion which leads the rotation axis to the bearing; and when the connector is positioned in the open position, the leading portion extends along the up-down direction and opens downward.

14. A connector device comprising a connector and a mating connector which is mateable with the connector, wherein:

the connector comprises a housing, a power-supply terminal and a detection terminal;

the housing is formed with an axis portion;

the power-supply terminal and the detection terminal are held by the housing;

the mating connector comprises a mating housing, a mating power-supply terminal and a mating detection terminal;

the mating housing is formed with a mating axis portion;

one of the axis portion and the mating axis portion is a rotation axis with an axis direction while a remaining one of the axis portion and the mating axis portion is a bearing;

when the axis portion and the mating axis portion are combined with each other, the connector is rotatable around the rotation axis between an open position and a closed position with respect to the mating connector;

the mating power-supply terminal and the mating detection terminal are held by the mating housing;

when the connector is positioned between the open position and the closed position, the connector is located above the mating connector in an up-down direction orthogonal to the axis direction of the rotation axis;

when the connector is positioned in the open position, the power-supply terminal is not connected to the mating power-supply terminal while the detection terminal is not connected to the mating detection terminal;

the connector is positioned in a regulation position which is located between the open position and the closed position, the power-supply terminal is connected to the mating power-supply terminal while the detection terminal is not connected to the mating detection terminal;

when the connector is positioned in the closed position, the power-supply terminal and the detection terminal are connected to the mating power-supply terminal and the mating detection terminal, respectively;

the housing is provided with a base portion, a cantilever portion which is resiliently deformable, a fitting regulated portion and an operation portion;

the cantilever portion extends from the base portion in a first predetermined orientation and has a thickness in a second predetermined orientation orthogonal to the first predetermined orientation;

the fitting regulated portion and the operation portion are supported by the cantilever portion;

the fitting regulated portion has a portion which is located within the thickness of the cantilever portion in the second predetermined orientation;

when the cantilever portion is resiliently deformed, the fitting regulated portion is moved at least in the second predetermined orientation;

the mating housing is provided with a fitting regulating portion;

when the connector is turned from the open position to the regulation position, the portion of the fitting regulated portion located within the thickness of the cantilever portion is brought into abutment with the fitting regulating portion and regulated to prevent the connector from being turned toward the closed position beyond the regulation position; and when the operation portion is operated to deform the cantilever portion resiliently, the regulation by the fitting regulating portion for the fitting regulated portion is released.

15. The connector device as recited in claim 14, wherein:

the fitting regulated portion is provided with a first abutment surface;

the first abutment surface is oriented in a third predetermined orientation opposite to the first predetermined orientation or in a composite orientation of the second predetermined orientation and the third predetermined orientation;

the fitting regulating portion is provided with a second abutment surface;

when the connector is positioned in the regulation position, the second abutment surface is oriented in the first orientation or a composite orientation of the first predetermined orientation and a fourth predetermined orientation opposite to the second predetermined orientation; and when the fitting regulated portion is brought into abutment with the fitting regulating portion, the first abutment surface faces the second abutment surface.

* * * * *